US010502210B2

(12) United States Patent
Gao et al.

(10) Patent No.: US 10,502,210 B2
(45) Date of Patent: Dec. 10, 2019

(54) VARIABLE-CAPACITY COMPRESSOR AND REFRIGERATION DEVICE HAVING SAME

(71) Applicant: Guangdong Meizhi Compressor Co., Ltd., Foshan (CN)

(72) Inventors: Bin Gao, Foshan (CN); Hualong Wu, Foshan (CN); Yangbo Yu, Foshan (CN)

(73) Assignee: GUANGDONG MEIZHI COMPRESSOR CO., LTD., Foshan (CN)

( * ) Notice: Subject to any disclaimer, the term of this patent is extended or adjusted under 35 U.S.C. 154(b) by 308 days.

(21) Appl. No.: 15/518,435

(22) PCT Filed: Feb. 2, 2016

(86) PCT No.: PCT/CN2016/073160
§ 371 (c)(1),
(2) Date: Apr. 11, 2017

(87) PCT Pub. No.: WO2017/132824
PCT Pub. Date: Aug. 10, 2017

(65) Prior Publication Data
US 2018/0045201 A1 Feb. 15, 2018

(51) Int. Cl.
*F04C 28/12* (2006.01)

(52) U.S. Cl.
CPC ..... *F04C 28/12* (2013.01)

(58) Field of Classification Search
CPC .... F04C 28/12; F04C 18/3564; F04C 28/065; F04C 23/001; F04C 23/008; F04C 18/24; F04C 18/26
See application file for complete search history.

(56) References Cited

U.S. PATENT DOCUMENTS 5,074,760 A * 12/1991 Hirooka ..... F04C 28/12 417/304
2004/0067146 A1 4/2004 Barito et al.

FOREIGN PATENT DOCUMENTS

CN 202483880 U 10/2012
CN 202500772 U 10/2012
(Continued)

OTHER PUBLICATIONS

JP2006046114 translation; Satodate Koji; (Year: 2006).*
(Continued)

*Primary Examiner* — Devon C Kramer
*Assistant Examiner* — David N Brandt
(74) *Attorney, Agent, or Firm* — Scully Scott Murphy & Presser

(57) ABSTRACT

The present disclosure relates to a variable-capacity compressor (100) and a refrigeration device (200). The variable-capacity compressor (100) comprises a housing (1), a compression mechanism, two first suction conduits (61) and a variable-capacity valve (3); the compression mechanism comprises two bearings (21, 22) and a cylinder assembly, the cylinder assembly comprises a first cylinder (23) and a second cylinder (24), at least one of the first cylinder (23) and the second cylinder (24) is configured as a variable-capacity cylinder, and a compression chamber (28) and a suction port (A) is formed in the variable-capacity cylinder; the variable-capacity valve (3) is disposed in the compression mechanism and configured to be movable between a communication position and an isolation position, wherein the variable-capacity cylinder operates when the variable-capacity valve (3) is located in the communication position, and the variable-capacity cylinder is unloaded when the variable-capacity valve (3) is located the isolation position.

20 Claims, 21 Drawing Sheets

(56) References Cited

FOREIGN PATENT DOCUMENTS

| | | | | | |
|---|---|---|---|---|---|
| CN | 103161729 | A | | 6/2013 | |
| CN | 103256223 | A | | 8/2013 | |
| CN | 204900247 | U | | 12/2015 | |
| CN | 205349733 | U | | 6/2016 | |
| JP | S5975591 | U | | 5/1984 | |
| JP | H07103856 | B2 | | 11/1995 | |
| JP | 2006046114 | | * | 2/2006 | ..... F04C 18/3564 |
| JP | 2006046114 | A | | 2/2006 | |

OTHER PUBLICATIONS

Japanese Patent Application No. 2017516716 Office Action dated Mar. 6, 2018, 6 pages.

Japanese Patent Application No. 2017516716 English translation of Office Action dated Mar. 6, 2018, 4 pages.

Chinese Patent Application No. 201610075000.7 First Office Action dated Jun. 2, 2017, 9 pages.

PCT/CN2016/073160 International Search Report and Written Opinion dated Nov. 22, 2016, 3 pages.

PCT/CN2016/073160 English translation of International Search Report dated Nov. 22, 2016, 3 pages.

Chinese Patent Application No. 201610075000.7 English translation of First Office Action dated Jun. 2, 2017,10 pages.

Chinese Patent Application No. 201610075000.7, English translation of Office Action dated Sep. 26, 2018, 5 pages.

Chinese Patent Application No. 201610075000.7, Office Action dated Sep. 26, 2018, 3 pages.

Chinese Patent Application No. 201610075000.7 Second Office Action dated Dec. 18, 2017, 9 pages.

Chinese Patent Application No. 201610075000.7 Second English translation of Office Action dated Dec. 18, 2017, 12 pages.

Office Action dated May 21, 2019 received in Indian Patent Application No. IN 201737008513.

* cited by examiner

VARIABLE-CAPACITY COMPRESSOR AND REFRIGERATION DEVICE HAVING SAME

CROSS-REFERENCE TO RELATED APPLICATIONS

The present application is a national phase entry under 35 USC § 371 of International Application PCT/CN2016/073160, filed Feb. 2, 2016, the entire disclosure of which is incorporated herein by reference.

FIELD

The present disclosure relates to a technical field of compressors, and more particularly to a variable-capacity compressor and a refrigeration device comprising the same.

BACKGROUND

With continuous shortage of the earth resources and deterioration of the environment, energy saving becomes a constant pursuit for an air conditioner, a refrigerator and etc., and especially for the air conditioner of large power consumption, the energy saving goal is more urgent, so a requirement for energy efficiency standard of the air conditioner is continuously improved. In the related art, although a system energy efficiency of the air conditioner is improved and energy consumption of a compressor is reduced, it will bring another adverse effect for the air conditioner using a conventional fixed-speed compressor, that is, in winter, especially at a low ambient temperature, a system heating capacity of the air conditioner is significantly reduced.

SUMMARY

The present disclosure seeks to solve at least one of the problems existing in the related art. To this end, an objective of the present disclosure is to provide a variable-capacity compressor, which simplifies a structure of the variable-capacity compressor.

Another objective of the present disclosure is to provide a refrigeration device having the above variable-capacity compressor.

According to a first aspect of the present disclosure, the variable-capacity compressor includes a housing; a compression mechanism disposed in the housing and including two bearings and a cylinder assembly disposed between the two bearings, in which the cylinder assembly includes a first cylinder and a second cylinder, at least one of the first cylinder and the second cylinder is configured as a variable-capacity cylinder, and a compression chamber and a suction port is formed in the variable-capacity cylinder; two first suction conduits connected to the first cylinder and the second cylinder respectively; and a variable-capacity valve disposed in the compression mechanism and configured to be movable between a communication position where the compression chamber is communicated with the suction port and an isolation position where the compression chamber is isolated from the suction port, wherein the variable-capacity cylinder operates when the variable-capacity valve is located in the communication position, and the variable-capacity cylinder is unloaded when the variable-capacity valve is located in the isolation position.

For the variable-capacity compressor according to the present disclosure, by providing the above variable-capacity valve located in the housing, the structure of the variable-capacity compressor is simplified, and reliability of the variable-capacity compressor applied in the refrigeration device is improved. Furthermore, when the variable-capacity cylinder operates, a suction path of the variable-capacity compressor is substantially consistent with that of a conventional compressor, such that performance of the variable-capacity cylinder may be well ensured.

According to an example of the present disclosure, the compression mechanism is provided with a pressure supply passage used for supplying the first pressure gas or the second pressure gas, and a pressure of the first pressure gas is greater than that of the second pressure gas; the variable-capacity valve is provided with a first pressure passage in communication with the pressure supply passage, and when the variable-capacity valve is located in the isolation position, the pressure supply passage supplies the first pressure gas into the compression chamber through the first pressure passage.

According to an example of the present disclosure, the compression mechanism is provided with an accommodating chamber in communication with the pressure supply passage, in which the variable-capacity valve is movably disposed in the accommodating chamber; when the first pressure gas is supplied into the pressure supply passage, the variable-capacity valve moves from the communication position to the isolation position, and when the second pressure gas is supplied into the pressure supply passage, the variable-capacity valve is maintained in the communication position.

According to an example of the present disclosure, the variable-capacity compressor further comprises at least one spring disposed between the variable-capacity valve and an inner wall of the accommodating chamber.

According to an example of the present disclosure, when the variable-capacity valve is located in the communication position, an inner wall of the pressure supply passage at a side of the pressure supply passage far away from a center of the variable-capacity valve is spaced apart from a corresponding end face of the variable-capacity valve.

According to an example of the present disclosure, a stop structure is disposed to the inner wall of the accommodating chamber, and when the variable-capacity valve is located in the communication position, the variable-capacity valve abuts against the stop structure.

According to an example of the present disclosure, the compression mechanism is provided with a suction hole, a first end of the suction hole is configured as the suction port, a second end of the suction hole is in communication with the accommodating chamber, and a diameter of the second end of the suction hole is denoted as d1; when a sectional shape of the variable-capacity valve is configured to be a square or a rectangle, a width of the variable-capacity valve is denoted as s, in which s and d1 satisfy: $s>d1$; when the variable-capacity valve is in the shape of a cylinder, a diameter of the variable-capacity valve is denoted as d2, in which, d1 and d2 satisfy: $d2>d1$.

According to an example of the present disclosure, when the variable-capacity valve is cylindrical in shape, a central axis of the variable-capacity valve intersects a central axis of the suction hole.

According to an example of the present disclosure, when the variable-capacity valve is cylindrical in shape, d1 and d2 further satisfy: $d2 \geq d1+0.5$ mm.

According to an example of the present disclosure, a second pressure passage is formed in the variable-capacity valve, and when the variable-capacity valve is located in the communication position, the second pressure passage communicates the compression chamber with the suction port.

According to an example of the present disclosure, the variable-capacity valve is movable in a vertical direction or in a horizontal direction.

According to an example of the present disclosure, the variable-capacity cylinder is provided with a sliding vane groove, a sliding vane is disposed in the sliding vane groove, and a part of the sliding vane groove located at a tail of the sliding vane is configured as a sliding vane chamber which is in communication with an interior of the housing.

According to an example of the present disclosure, a magnetic material member is disposed to the tail of the sliding vane groove.

According to an example of the present disclosure, a partition plate is disposed between the first cylinder and the second cylinder, and the variable-capacity valve is disposed to at least one of the partition plate and the two bearings.

According to an example of the present disclosure, the compression mechanism is provided with a valve base, and the variable-capacity valve is disposed on the valve base.

According to an example of the present disclosure, a displacement of the variable-capacity cylinder is denoted as q, and an overall displacement of the variable-capacity compressor is denoted as Q, in which, q and Q satisfy: $q/Q \leq 50\%$.

According to a second aspect of the present disclosure, the refrigeration device includes a variable-capacity compressor according to the first aspect of the present disclosure.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of embodiments of the present disclosure will become apparent and more readily appreciated from the following descriptions made with reference to the drawings, in which.

REFERENCE NUMERALS

Figure 1A:
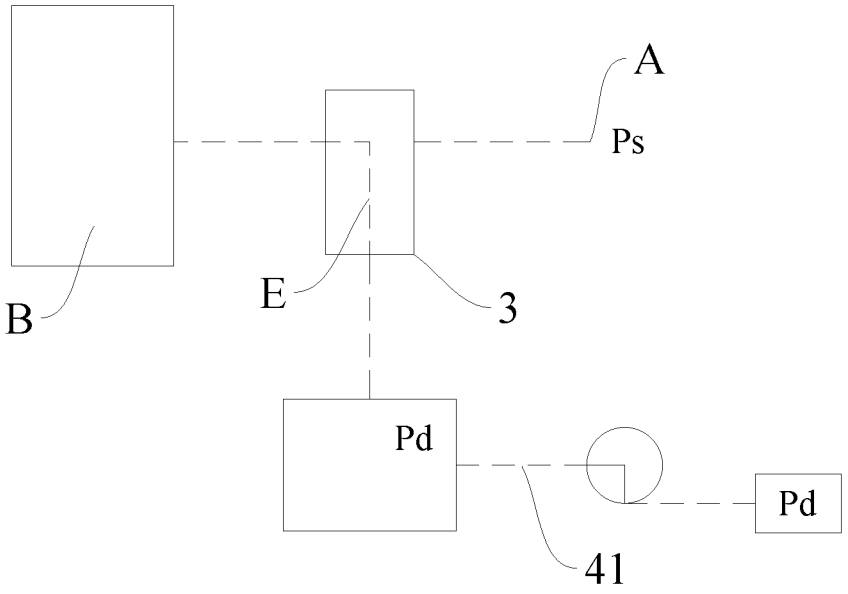
FIG. 1*a* and FIG. 1*b* are schematic views of a variable-capacity principle of a variable-capacity compressor according to an embodiment of the present disclosure, in which a variable-capacity valve of FIG. 1*a* is in an isolation position, and a variable-capacity valve of FIG. 1*b* is in a communication position.

100: variable-capacity compressor;

1: housing; 11: exhaust port;

21: main bearing; 22: auxiliary bearing; 221: accommodating chamber; 2211: stop structure; 23: first cylinder; 24: second cylinder; 241: suction hole; 2411: first suction segment; 2412: second suction segment; 242: sliding vane chamber; 25: partition plate; 26: crankshaft; 27: piston; 28: working chamber; 29: sliding vane;

3: variable-capacity valve; 4: pressure supply conduit; 41: pressure supply passage;

5: electric motor; 51: stator; 52: rotor;

6: liquid reservoir; 61: first suction conduit; 62: second suction conduit;

7: spring; 8: magnetic material member; 9: valve base;

A: suction port; B: compression chamber; E: first pressure passage; D: second pressure passage;

200: refrigeration device;

201: first heat exchanger; 202: second heat exchanger;

203: first control valve; 2031: first valve port; 2032: second valve port;

2033: third valve port; 2034: fourth valve port;

204: throttling element; 205: second control valve;

2051: first port; 2052: second port; 2053: third port.

DETAILED DESCRIPTION

Description will be made in detail to embodiments of the present disclosure, and examples of the embodiments will be illustrated in drawings. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification of the present disclosure, it should be understood that the terms such as "center", "longitudinal", "transverse", "length", "width", "thickness", "upper", "lower", "front", "rear", "left", "right", "vertical", "horizontal", "top", "bottom", "inner", "outer", "clockwise", "counterclockwise", etc. should be construed to refer to the orientation as then described or as shown in the drawings under discussion. These relative terms are for convenience and simplifying of description, and do not alone indicate or imply that the device or element referred to must have a particular orientation, or be constructed or operated in a particular orientation. Therefore, these relative terms should not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted", "connected", "coupled" and the like are used broadly, and may be, for example, fixed connections, detachable connections, or integral connections; may also be mechanical or electrical connections; may also be direct connections or indirect connections via intervening structures; may also be inner communications or interactions of two elements, which can be understood by those skilled in the art according to specific situations.

Hereinafter, a variable-capacity compressor 100 according to an embodiment of the present disclosure will be described in the following description with reference to FIGS. 1*a* to 20. The variable-capacity compressor 100 may be applied in a refrigeration device 200, but it is not limited thereto. In the following description of the present application, the case where the variable-capacity compressor 100 is applied in the refrigeration device 200 is taken as an example for illustration.

Figure 2:
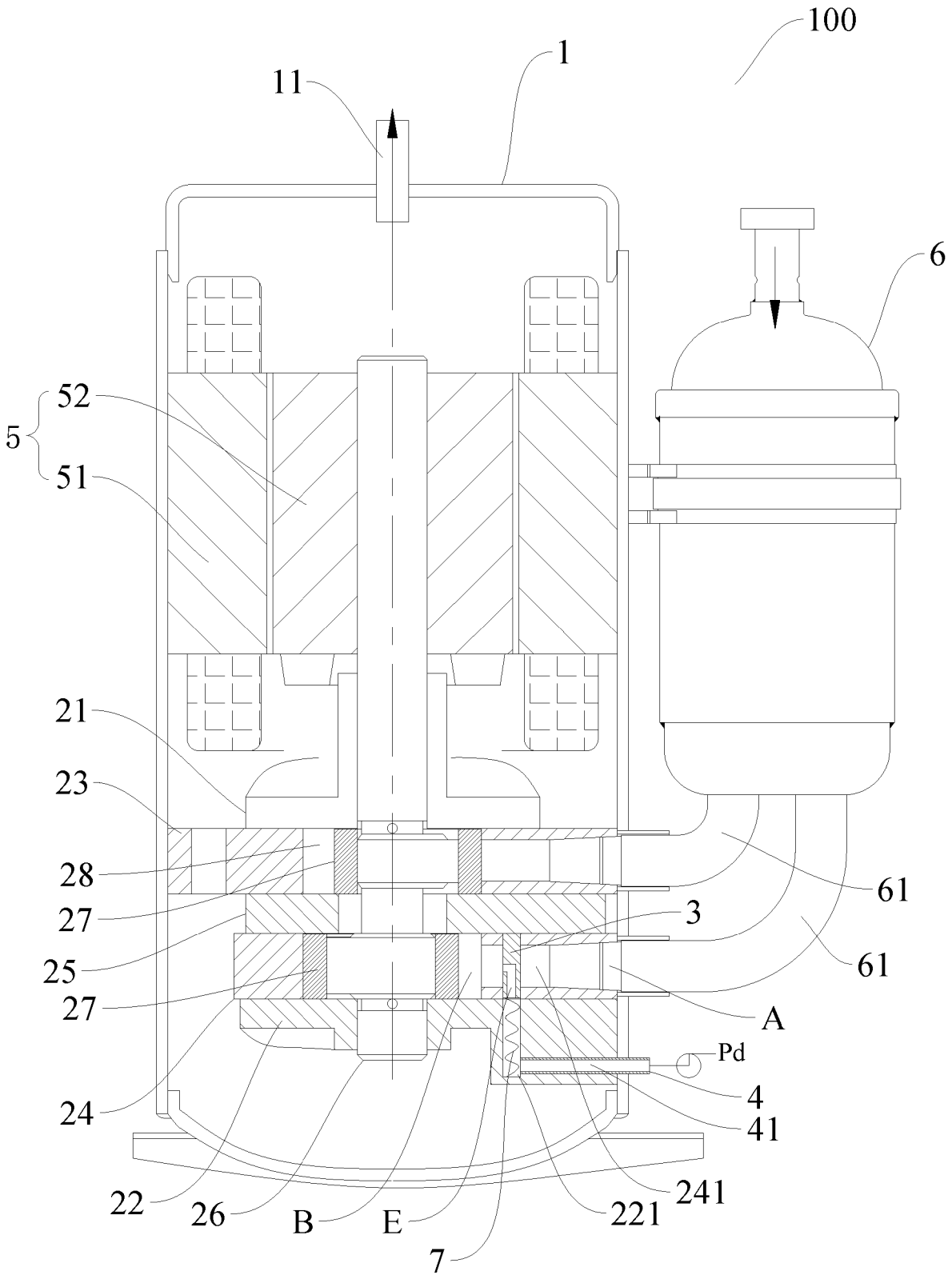
FIG. 2 and FIG. 3 are schematic views of a variable-capacity compressor according to an embodiment of the present disclosure, in which a variable-capacity valve of FIG. 2 is in an isolation position, and a variable-capacity valve of FIG. 3 is in a communication position.
Figure 3:
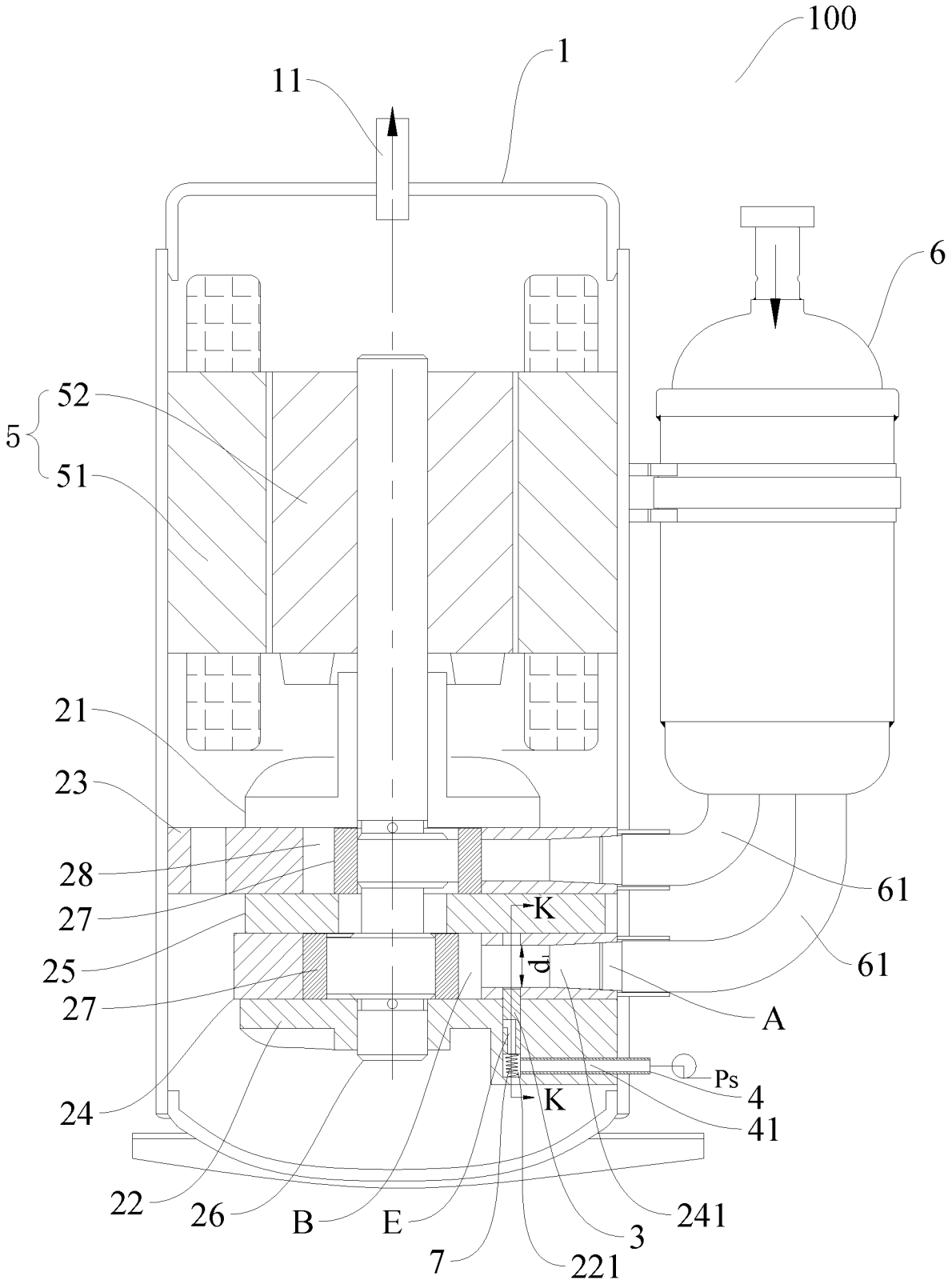
Figure 4:
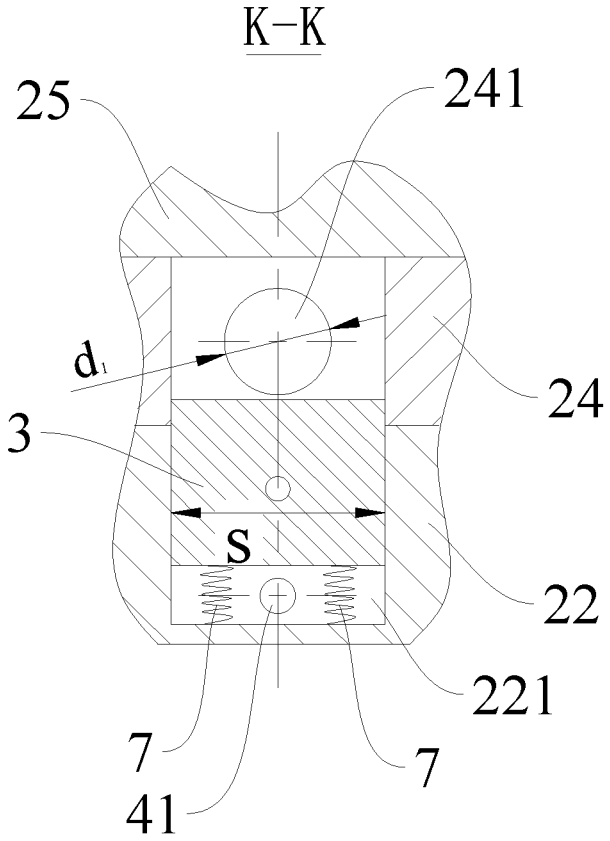
FIG. 4 is a sectional view of FIG. 3 taken along line K-K.

As shown in FIGS. 2 and 3, the variable-capacity compressor 100 according to embodiments of a first aspect of the present disclosure includes a housing 1, a compression mechanism and a variable-capacity valve 3.

The compression mechanism is disposed in the housing 1, and the compression mechanism includes two bearings and a cylinder assembly disposed between the two bearings. The cylinder assembly includes a variable-capacity cylinder, a compression chamber B is formed in the variable-capacity cylinder, and a suction port A is formed in the compression mechanism. In the following description of the present application, the two bearings are referred to as a main bearing 21 and an auxiliary bearing 22 respectively for convenience of description.

The variable-capacity valve 3 is disposed in the compression mechanism, and the variable-capacity valve 3 is also located in the housing 1 at the same time. The variable-capacity valve 3 is configured to be movable between a communication position where the compression chamber B is communicated with the suction port A and an isolation position where the compression chamber B is isolated from the suction port A. The variable-capacity cylinder operates when the variable-capacity valve 3 is located in the communication position, and the variable-capacity cylinder is unloaded when the variable-capacity valve 3 is located in the isolation position.

When the variable-capacity valve 3 is located in the communication position, since the compression chamber B of the variable-capacity cylinder is in communication with the suction port A, a low-pressure refrigerant may be sucked into the compression chamber B via the suction port A and undergo a compression operation therein, in which case the variable-capacity cylinder participates in the compression operation. However, when the variable-capacity valve 3 is located in the isolation position, since the compression chamber B of the variable-capacity cylinder is not in communication with the suction port A, the low-pressure refrigerant may not enter the compression chamber B, and the variable-capacity cylinder does not participate in the compression operation.

For example, in a case that the refrigeration device 200 having the variable-capacity compressor 100 is applied in an air conditioner, when the air conditioner needs to operates with lower power consumption, the variable-capacity valve 3 may be located in the isolation position, in which case the variable-capacity cylinder does not operate, and the variable-capacity compressor 100 may operates in a small capacity. However, when the air conditioner needs to improve performance thereof such as in a low-temperature heating condition, the variable-capacity valve 3 may be located in the communication position, in which case the variable-capacity cylinder participates in the compression operation, and the variable-capacity compressor 100 may operate in a large capacity, thus ensuring an operation effect of the air conditioner.

Herein, the "capacity" may be construed as a capacity of the entire variable-capacity compressor 100, i.e. a sum of capacities of a plurality of cylinders included in the cylinder assembly, also referring to as a working volume or displacement. A capacity of each cylinder refers to a maximum suction volume during one revolution of a piston 27.

Thus, for the variable-capacity compressor 100 according to embodiments of the present disclosure, by providing the above-described variable-capacity valve 3, located in the housing 1, a structure of the variable-capacity compressor 100 is simplified, and reliability of the variable-capacity compressor 100 when used in the refrigeration device 200 is improved. Furthermore, when the variable-capacity cylinder operates, a suction path of the variable-capacity compressor 100 is substantially consistent with that of a conventional compressor, such that performance of the variable-capacity cylinder may be well ensured.

Figure 1B:
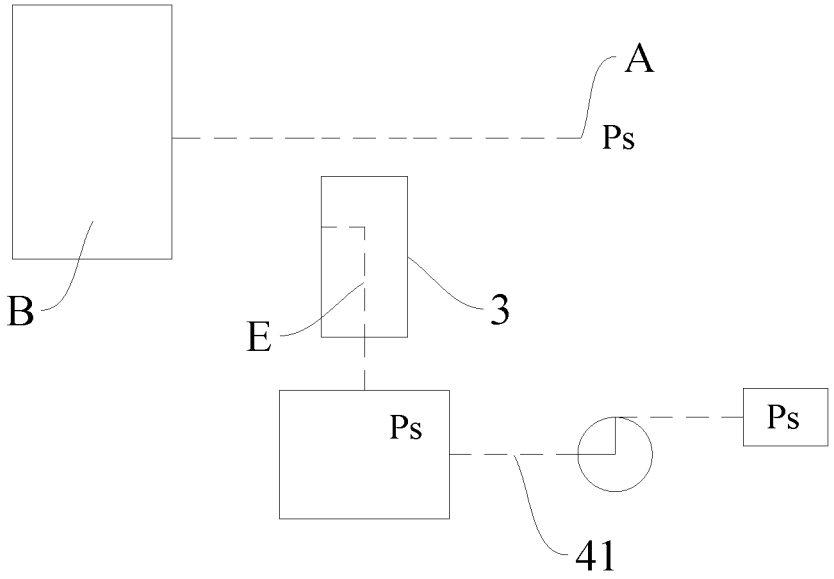

First of all, a variable-capacity principle of the variable-capacity compressor 100 according to one embodiment of the present disclosure will be illustrated with reference to FIGS. 1*a* and 1*b*. FIGS. 1*a* and 1*b* show the suction port A, the compression chamber B of the variable-capacity cylinder, the variable-capacity valve 3, a first pressure passage E formed in the variable-capacity valve 3, and a pressure supply passage 41 (may also be in the form of a conduit segment) in communication with a side of the variable-capacity valve 3. An essential work principle thereof is as follows:

When a first pressure gas (for example, having an discharge pressure Pd) is introduced into a side of the variable-capacity valve 3 (for example, a lower side thereof shown in FIG. 1*a*) via the pressure supply passage 41, a gravity of the variable-capacity valve 3 will be overcome to move the variable-capacity valve 3 upward under the action of a high pressure at a lower end face thereof, such that the variable-capacity valve 3 isolates a suction passage of the variable-capacity cylinder (i.e. a suction hole 241 as follows). That is, the suction hole 241 between the suction port A and the compression chamber B is blocked by the variable-capacity valve 3, such that a low-pressure refrigerant at the suction port A cannot be transferred into the compression chamber B of the variable-capacity cylinder, i.e. the variable-capacity cylinder cannot suck in the low-pressure refrigerant. Furthermore, after the variable-capacity valve 3 moves upward, the first pressure passage E communicates the pressure supply passage 41 with the compression chamber B, such that the first pressure gas is sucked into the compression chamber B. In this case, the variable-capacity cylinder is provided with a sliding vane groove, a sliding vane 29 is disposed in the sliding vane groove, and a part of the sliding vane groove located at a tail of the sliding vane is configured as a sliding vane chamber 242; the sliding vane chamber 242 contains the discharge pressure, the tail (i.e. an end of the sliding vane 29 far away from a center of the variable-capacity cylinder) and a head (i.e. an end of the sliding vane 29 adjacent to the center of the variable-capacity cylinder) of the sliding vane 29 of the variable-capacity cylinder are both subjected to the discharge pressure, and hence no differential pressure effect may be formed, so that the head of the sliding vane 29 is separated from an outer circumferential wall of the piston 27 in the compression chamber B, and the variable-capacity cylinder dose not participate in the compression operation. In this case, the variable-capacity compressor 100 operates in a partial capacity work mode.

When a second pressure gas (for example, having a suction pressure Ps) is introduced into the above-described side of the variable-capacity valve 3, the lower end face of the variable-capacity valve 3 is subjected to a low pressure, in which case the variable-capacity valve 3 moves downward under the action of its own gravity, the compression chamber B and the first pressure passage E are staggered in an up-and-down direction, the compression chamber B is re-communicated with the suction port A previously blocked by the variable-capacity valve 3, and the low-pressure refrigerant may enter the compression chamber B of the variable-capacity cylinder via the suction port A. In this case, since the sliding vane chamber 242 maintains the discharge pressure therein, the head of the sliding vane 29 abuts against the outer circumferential wall of the piston 27 due to a differential pressure between the discharge pressure at the tail thereof and the suction pressure at the head thereof, such that the variable-capacity cylinder participates in the compression operation normally. In this case, the variable-capacity compressor 100 operates in a full capacity work mode.

In summary, the present disclosure changes the force situation of the sliding vane 29 by controlling an inner pressure of the variable-capacity cylinder, thus realizing contact of the sliding vane 29 with or separation thereof from the piston 27, so as to achieve loading or unloading of the variable-capacity cylinder.

The variable-capacity compressor 100 according to one specific embodiment of the present disclosure will be described below referring to FIGS. 2 to 11 in combination with the above variable-capacity principle. The variable-capacity compressor 100 is configured as a vertical compressor (as shown in FIG. 2), i.e. a compressor in which a central axis of a cylinder is perpendicular to a mounting surface such as a ground surface. Of course, the variable-capacity compressor 100 may also be configured as a horizontal compressor (not illustrated), in which case the central axis of the cylinder is substantially parallel to the mounting surface such as the ground surface. In the following description of the present disclosure, the case where the variable-capacity compressor 100 is configured as the vertical compressor is taken as an example for illustration.

As shown in FIGS. 2 and 3, the variable-capacity compressor includes the housing 1, an electric motor 5, the compression mechanism and a liquid reservoir 6. An inner space of the housing 1 may be a high pressure space having the discharge pressure. The liquid reservoir 6 is disposed outside the housing 1. The electric motor 5 and the compression mechanism are both disposed in the housing 1, and the electric motor 5 is located above the compression mechanism. The electric motor 5 includes a stator 51 and a rotor 52, and the rotor 52 may be rotatably disposed in the stator 51.

The compression mechanism includes the main bearing 21, a cylinder assembly, the auxiliary bearing 22, the piston 27, the sliding vane 29 and a crankshaft 26. The main bearing 21 is disposed to an upper end of the cylinder assembly and the auxiliary bearing 22 is disposed to a lower end of the cylinder assembly. The cylinder assembly includes two cylinders and a partition plate 25 disposed between the two cylinders. Each cylinder has a working chamber 28 and the sliding vane groove, and the sliding vane groove may extend in a radial direction of the working chamber 28. The piston 27 is disposed in the working chamber 28, the sliding vane 29 is movably disposed in the sliding vane groove, and the head of the sliding vane 29 is configured to abut against the outer circumferential wall of the piston 27. The crankshaft 26 has an upper end connected to the rotor 52 and a lower end penetrating the main bearing 21, the cylinder assembly and the auxiliary bearing 22. When the electric motor 5 is in operation, the rotor 52 may drive the piston 27 fitted over an eccentric portion of the crankshaft 26 to roll along an inner wall of the working chamber 28 via the crankshaft 26 to perform compression of the refrigerant entering the working chamber 28. The partition plate 25 may be one separate component, or may be constituted by a plurality of components.

The liquid reservoir 6 is connected to a first cylinder 23 and a second cylinder 24 via two first suction conduits 61 respectively, such that a refrigerant to be compressed (i.e. the low-pressure refrigerant) is introduced into the working chambers 28 of the first cylinder 23 and the second cylinder 24 respectively. In this case, the suction port A is formed in the variable-capacity cylinder, and is in communication with the suction pressure all the time.

The variable-capacity compressor 100 is configured as a multi-cylinder compressor. FIGS. 2 and 3 show a dual-cylinder compressor for an explanatory and illustrative purpose, but after reading the following technical solution, it is apparent to those skilled in the art to understand that the solution may be applied to a technical solution of three cylinders or more cylinders, and it is also within the scope of the present disclosure. In the following description of the present application, the case where the variable-capacity compressor 100 is configured as the dual-cylinder compressor is taken as an example for illustration. In addition, for convenience of description, the above two cylinders are referred to as the first cylinder 23 and the second cylinder 24 respectively.

At least one of the first cylinder 23 and the second cylinder 24 is configured as the variable-capacity cylinder (the corresponding working chamber 28 thereof is referred to as the compression chamber B). As an example shown in FIGS. 2 and 3, the upper first cylinder 23 is configured as a normally operating cylinder, and the lower second cylinder 24 is configured as the variable-capacity cylinder. When the variable-capacity cylinder is in operation, the first cylinder 23 is always in operation, regardless of whether the second cylinder 24 is in operation or not. That is, the sliding vane 29 in the first cylinder 23 always abuts against the piston 27 to perform the compression of the refrigerant entering therein. Under normal circumstances, the tail of the sliding vane 29 of the normally operating cylinder may be provided with a spring member to facilitate a smooth start-up of the variable-capacity compressor 100.

The compression mechanism is provided with the pressure supply passage 41, as shown in FIGS. 2 and 3, and the pressure supply passage 41 is formed in the auxiliary bearing 22, and used for supplying the first pressure gas or the second pressure gas, in which the pressure of the first pressure gas is greater than that of the second pressure gas. Preferably, the first pressure gas is a refrigerant having the discharge pressure after compressed by the variable-capacity compressor 100, and the second pressure gas is a refrigerant having the suction pressure sucked to be compressed by the variable-capacity compressor 100.

The sliding vane chamber 242 is in communication with the housing 1, the sliding vane chamber 242 has the discharge pressure, and that is, the tail of the sliding vane 29 is subjected to the discharge pressure. The sliding vane chamber 242 is preferably in direct communication with the housing 1, in which case, an outer side of the sliding vane chamber 242 is opened. Thus, the structure of the sliding vane chamber 242 is simplified. Furthermore, the sliding vane 29 may be in direct contact with lubrication oil in an oil sump at a bottom of the housing 1 through the sliding vane chamber 242, which results in a good lubricating effect on the sliding vane 29, and further ensures reliability and performance of the variable-capacity compressor 100 over a long period of operation. Of course, the present disclosure is not limited thereto, and the sliding vane chamber 242 may have the discharge pressure therein in other manners. It should be noted herein that, a direction "outer" may be construed as a direction far away from a center of a cylinder, and the opposite direction thereof is defined as "inner".

The variable-capacity valve 3 is movable in a vertical direction, so as to achieve communication and isolation between the suction port A and the compression chamber B. The variable-capacity valve 3 is provided with the first pressure passage E, and the first pressure passage E may be configured as an inverted-L shape as shown in FIGS. 2 and 3, which is not limited thereto. The first pressure passage E is in communication with the pressure supply passage 41, and when the variable-capacity valve 3 is located in the isolation position, the pressure supply passage 41 supplies the first pressure gas into the compression chamber B through the first pressure passage E. The pressure of the first pressure gas is substantially equal to the discharge pressure at the tail of the sliding vane 29, which does not cause the differential pressure, such that the head of the sliding vane 29 in the variable-capacity cylinder is separated from the piston 27, in which case the variable-capacity cylinder is not in operation (i.e. unloaded). However, when the variable-capacity valve 3 is located in the communication position, the low-pressure refrigerant from the liquid reservoir 6 may enter the compression chamber B of the variable-capacity cylinder through the suction port A, while the second pressure gas may not enter the compression chamber B through the first pressure passage E. The pressure of the low-pressure refrigerant is less than the discharge pressure at the tail of the sliding vane 29, such that the head of the sliding vane 29 will abut against the outer circumferential wall of the piston 27, and the low-pressure refrigerant entering the compression chamber B will be compressed by the variable-capacity cylinder, in which case the variable-capacity cylinder is in operation. It should be understood by those skilled in the art that, the variable-capacity valve 3 may be movable in a horizontal direction (not illustrated).

Thus, a compression capacity of the variable-capacity compressor 100 is adjusted by making the variable-capacity cylinder participate in or not participate in the compression operation, such that variable-capacity operation of the variable-capacity compressor 100 is achieved.

The suction hole 241 and an accommodating chamber 221 are formed in the compression mechanism, and the variable-capacity valve 3 may be disposed to at least one of the partition plate 25, the main bearing 21, the auxiliary bearing 22, the first cylinder 23 and the second cylinder 24. For example, as shown in FIGS. 2 and 3, a first end of the suction hole 241 (for example, a right end in FIGS. 2 and 3) is configured as the suction port A, which is configured to communicate the suction port A with the compression chamber B to introduce the refrigerant into the compression chamber B; a second end of the suction hole 241 is in communication with the accommodating chamber 221; the accommodating chamber 221 is formed in the auxiliary bearing 22, penetrates an upper end face of the auxiliary bearing 22, and is in communication with the suction hole 241, in which the variable-capacity valve 3 is movably disposed in the accommodating chamber 221, and may move upward into the suction hole 241 to isolate the suction port A from the compression chamber B; the accommodating chamber 221 is in communication with the pressure supply passage 41 (for example, in FIGS. 2 and 3, the pressure supply passage 41 is in communication with a lower portion of the accommodating chamber 221), when the first pressure gas is supplied into the pressure supply passage 41, the variable-capacity valve 3 moves from the communication position to the isolation position, and when the second pressure gas is supplied into the pressure supply passage 41, the variable-capacity valve 3 is maintained in the communication position. Thereby, the movement of the variable-capacity valve 3 is achieved by supplying different pressure gases into the pressure supply passage 41.

The variable-capacity compressor 100 further includes at least one spring 7 disposed between the variable-capacity valve 3 and an inner wall of the accommodating chamber 221. For example, referring to FIGS. 2 and 3, the spring 7 is disposed between a bottom of the variable-capacity valve 3 and a bottom wall of the accommodating chamber 221, and the spring 7 may be configured to normally pull the variable-capacity valve 3 towards a direction of the communication position. It should be understood that, the number of the spring 7 depends on an elastic force as practically required.

When the first pressure gas (having the discharge pressure Pd) is introduced into the accommodating chamber 221, the variable-capacity valve 3 overcomes the gravity and the elastic force of the spring 7 under the action of the high pressure at the lower end face of the variable-capacity valve 3, moves upward into the suction hole 241 of the second cylinder 24, and isolates the suction port A from the compression chamber B, as shown in FIG. 2, in which case the compression chamber B is in communication with the accommodating chamber 221 through the first pressure passage E in the variable-capacity valve 3, the first pressure gas is introduced into the pressure supply passage 41 through the accommodating chamber 221, and the head and the tail of the sliding vane 29 of the second cylinder 24 are both subjected to the discharge pressure, which does not cause the differential pressure, such that the head of the sliding vane 29 is separated from the piston 27 in second cylinder 24, and the second cylinder 24 does not participate in the compression operation, in which case the variable-capacity compressor 100 operates in the partial capacity work mode. When the second pressure gas (having the suction pressure Ps) is introduced into the accommodating chamber 221, the variable-capacity valve 3 is retracted into the accommodating chamber 221 under the action of the spring 7 and the gravity, and as shown in FIG. 3, the first pressure passage E is sealed by the inner wall of the accommodating chamber 221, in which case the compression chamber B of the second cylinder 24 is in communication with the suction port A, and the compression chamber B sucks the low-pressure refrigerant (having the suction pressure). Since the tail of the sliding vane 29 is in communication with the discharge pressure of the inner space of the housing 1, the head of the sliding vane 29 abuts against the outer circumferential wall of the piston 27 under the action of the pressure at the tail thereof, and the variable-capacity cylinder participates in the compression operation, in which case the variable-capacity compressor 100 operates in the dual-cylinder work mode, and the work capacity is the full capacity.

Figure 8:
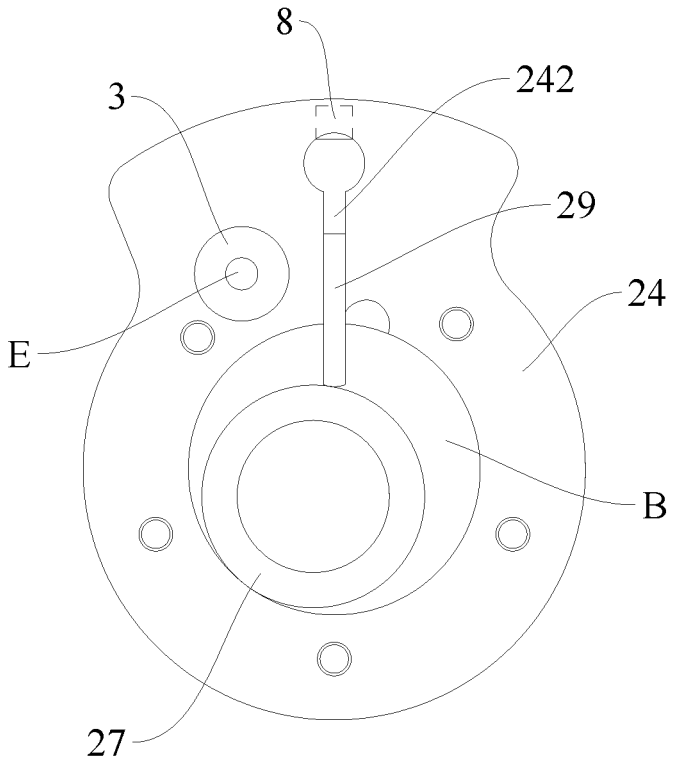
FIG. 8 is a schematic view of a variable-capacity cylinder according to an embodiment of the present disclosure.

In order to reduce a phenomenon that the head of the sliding vane 29 and the outer circumferential wall of the piston 27 collide during the unloading or an initial stage of the loading (i.e. operation) of the variable-capacity cylinder, as shown in FIG. 8, in the sliding vane chamber 242, the spring 7 of the sliding vane 29 that pushes the sliding vane 29 to abut against the piston 27 is removed.

Further, a magnetic material member 8 is disposed to the tail of the sliding vane groove, such as a magnet, etc. The magnetic material member 8 may be located in the sliding vane groove of the variable-capacity cylinder. Therefore, when the pressures at two ends of the sliding vane 29 is substantially equal or the differential pressure is small, the sliding vane 29 in the variable-capacity cylinder may be attracted by the magnetic material member 8, such that the head of the sliding vane 29 is separated from the piston 27, so as to avoid the collision of the head of the sliding vane 29 and the piston 27. When a thrust force on the sliding vane 29 due to the differential pressure at two ends of the sliding vane 29 is greater than an attraction force of the magnetic material member 8 to the sliding vane 29, the sliding vane 29 will move inward and abuts against the piston 27 to achieve the compression. Optionally, the magnetic material member 8 may also be disposed at other corresponding positions of the tail of the sliding vane 29, for example, to the main bearing 21, to the auxiliary bearing 22, or to the partition plate 25, etc.

Optionally, a diameter of the second end of the suction hole 241 is denoted as $d_1$, in which case the suction hole 241 is a circular hole, but is not limited thereto. A cross section of the variable-capacity valve 3 may be in the shape of a polygon, such as a square or the like. In an example of FIG. 4, the cross section of the variable-capacity valve 3 is configured to be in the shape of a rectangle, in which case a width of the variable-capacity valve 3 is denoted as s, in which, s and $d_1$ satisfy: $s>d_1$, such that the variable-capacity valve 3 may completely seal the suction hole 241.

Figure 5:
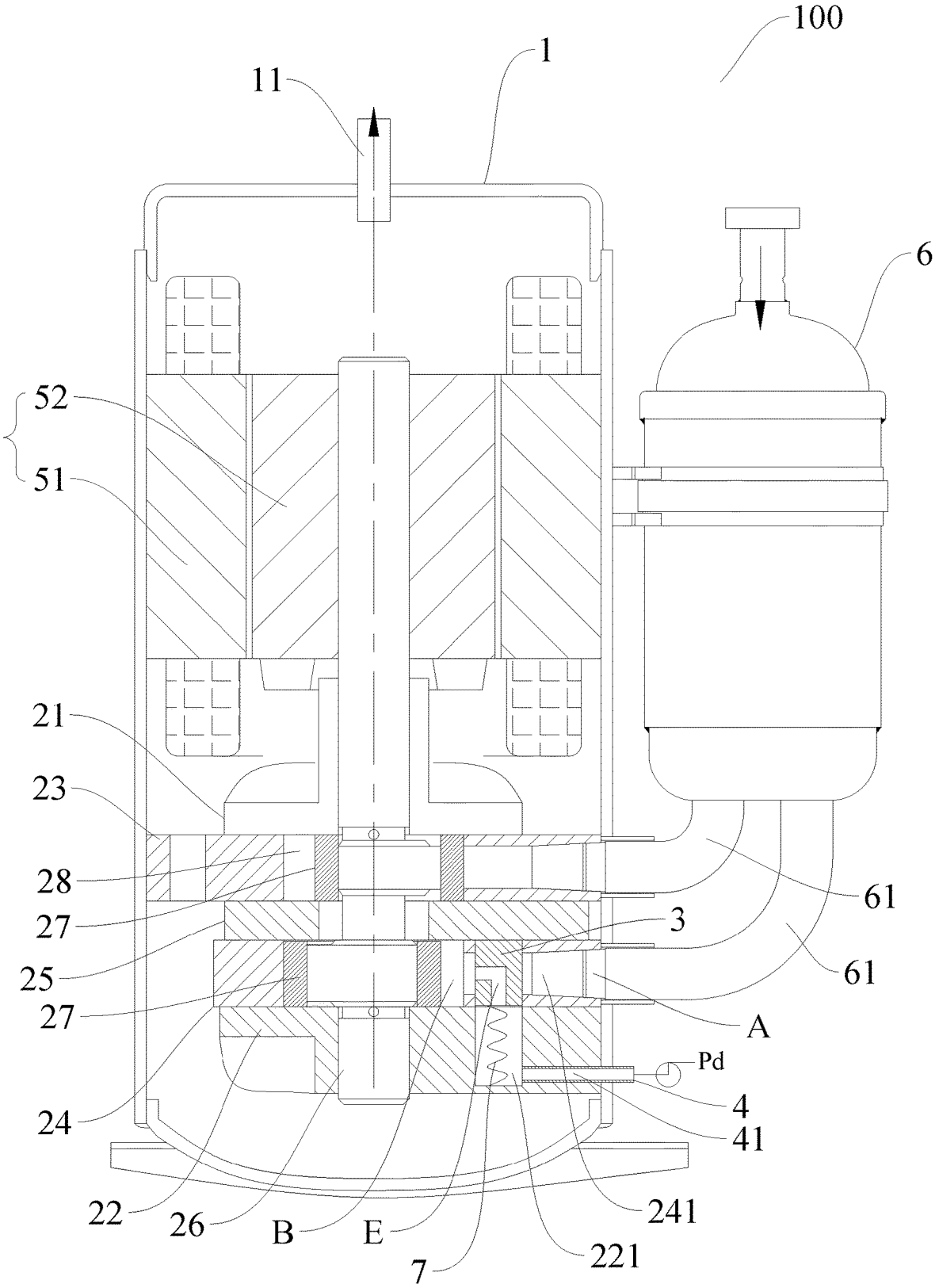
FIG. 5 is a schematic view of a variable-capacity compressor according to an embodiment of the present disclosure, in which a variable-capacity valve is configured to be cylindrical.

Certainly, the variable-capacity valve 3 may also be in the shape of a cylinder, as shown in FIGS. 5 and 8, a diameter of the variable-capacity valve 3 is denoted as $d_2$, in which, $d_1$ and $d_2$satisfy: $d_2>d_1$. Further, $d_1$ and $d_2$ satisfy: $d_2\geq d_1+0.5$ mm. Further, $d_1$ and $d_2$ satisfy: $d_2\geq d_1+1$ mm. And further, $d_1$ and $d_2$ may also satisfy: $d_2\geq d_1+2$ mm, thus ensuring that the variable-capacity valve 3 has a certain sealing length in a circumferential direction thereof. Preferably, a central axis of the variable-capacity valve 3 intersects a central axis of the suction hole 241.

Figure 6:
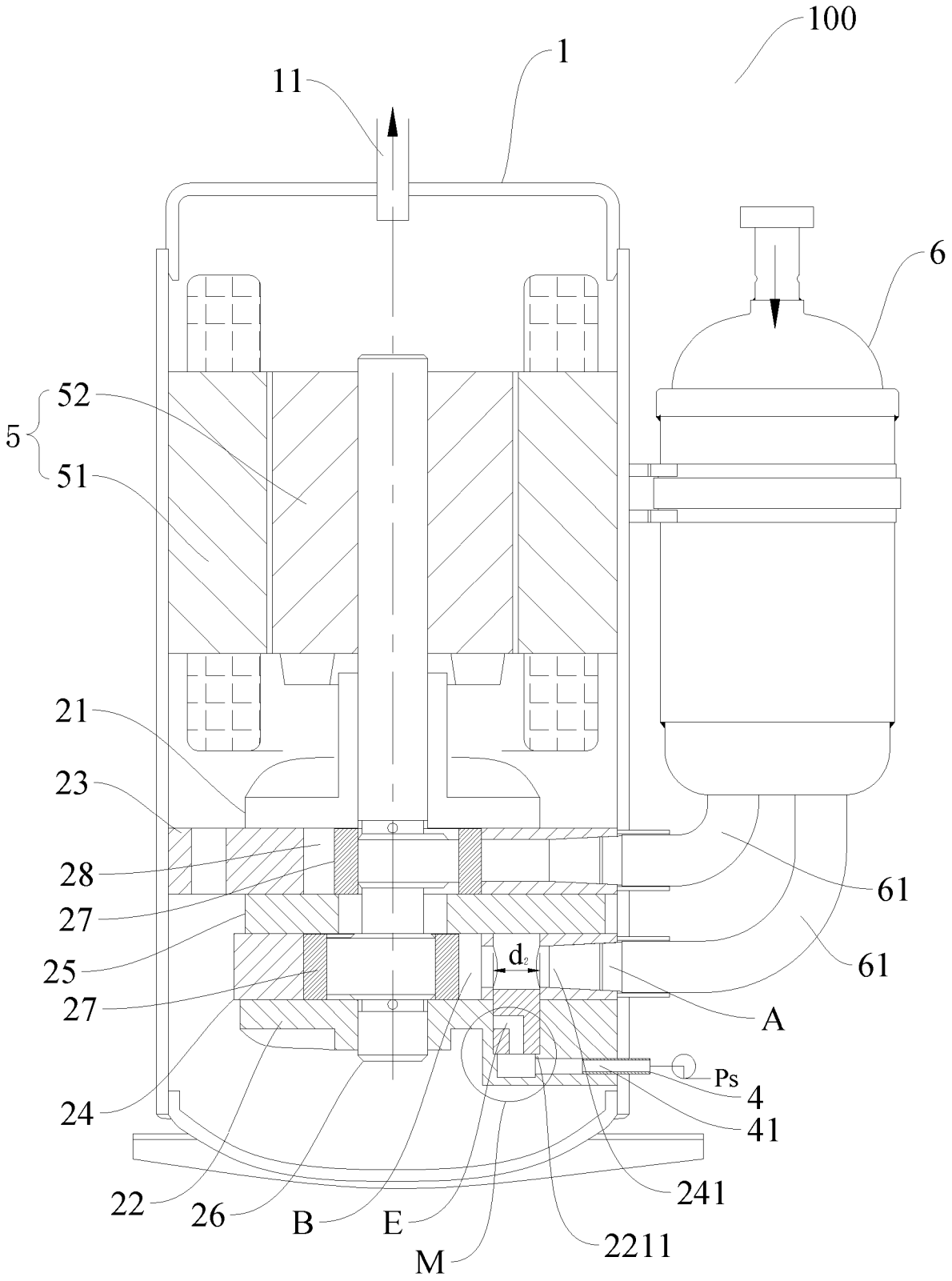
FIG. 6 is a schematic view of a variable-capacity compressor according to an embodiment of the present disclosure, in which no spring is provided.
Figure 7:
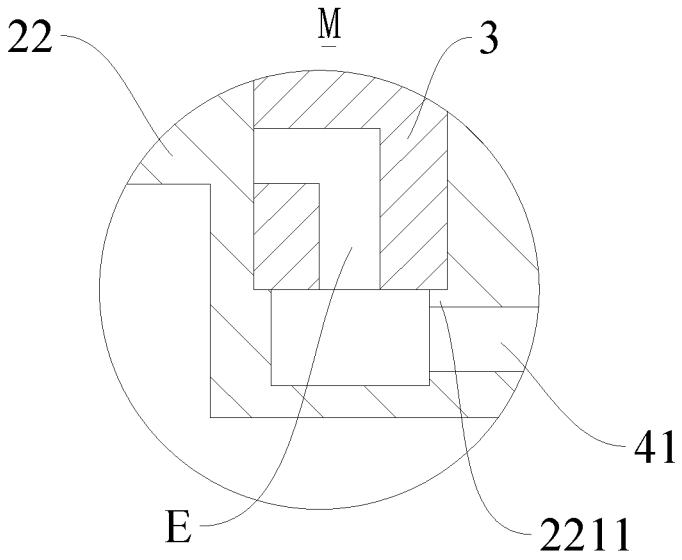
FIG. 7 is an enlarged view of a circled portion M of FIG. 6.

Referring to FIG. 6 in combination with FIG. 7, the pressure supply passage 41 extends horizontally, and when the variable-capacity valve 3 is located in the communication position, an inner wall of the pressure supply passage 41 (for example, a bottom wall in FIG. 6) at a side of the pressure supply passage 41 far away from the center of the variable-capacity valve 3 is spaced apart from a corresponding end face (for example, a lower end face in FIG. 6) of the variable-capacity valve 3. Thus, it can be ensured that the gas introduced via the pressure supply passage 41 (including the above first pressure gas and second pressure gas) may act on the above corresponding end face of the variable-capacity valve 3, such that the variable-capacity valve 3 may move smoothly in the accommodating chamber 221. In such a case, the spring 7 may not be disposed between the lower end face of the variable-capacity valve 3 and the bottom wall of the accommodating chamber 221, and the variable-capacity valve 3 achieves the up-and-down movement under the action of its own gravity and the pressure of the gas exerted on the lower end face of the variable-capacity valve 3.

Specifically, a stop structure 2211 such as a step part may be disposed to the inner wall of the accommodating chamber 221, and the step part is spaced apart from the inner wall at the above-described side of the pressure supply passage 41. When the variable-capacity valve 3 is located in the communication position, the variable-capacity valve 3 abuts against the step part, in which case the variable-capacity valve 3 may be supported on the step part, without contacting the inner wall at the above-described side of the pressure supply passage 41. It should be understood that, the stop structure 2211 of the accommodating chamber 221 may also be a protrusion (not illustrated), etc., as long as the structure may prevent the variable-capacity valve 3 from moving to contact the inner wall at the above-described side of the pressure supply passage 41.

Certainly, the first pressure gas or the second pressure gas may be introduced to the lower end face of the variable-capacity valve 3 directly, in which case a central axis of an end of the pressure supply passage 41 connected to the accommodating chamber 221 may be perpendicular to a bottom wall of the accommodating chamber 221, and the variable-capacity valve 3 may contact the bottom wall of the accommodating chamber 221. Thus, the first pressure gas or the second pressure gas supplied by the pressure supply passage 41 may directly act on the lower end face of the variable-capacity valve 3, so as to ensure that the variable-capacity valve 3 is movable between the communication position and the isolation position.

Figure 9:
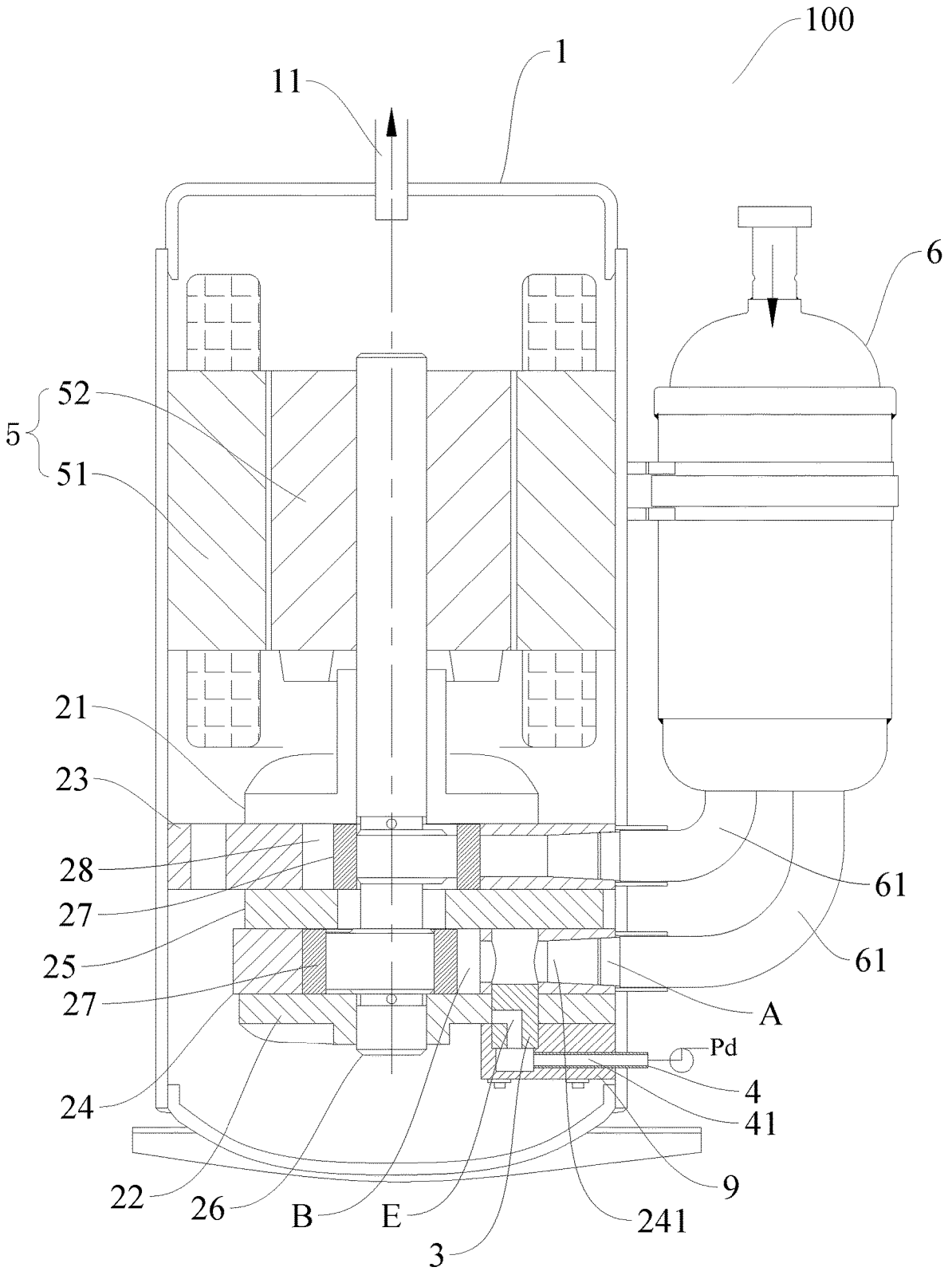
FIG. 9 is a schematic view of a variable-capacity compressor according to an embodiment of the present disclosure, in which a variable-capacity valve is disposed on a valve base.

The compression mechanism is provided with a valve base 9, in which the variable-capacity valve 3 is disposed on the valve base 9. For example, as shown in FIG. 9, the valve base 9 is disposed to a lower end of the auxiliary bearing 22, the valve base 9 and the auxiliary bearing 22 are two separated parts, and the pressure supply passage 41 and the accommodating chamber 221 may both be formed in the valve base 9, so as to simply the processing of the auxiliary bearing 22. Correspondingly, a communication hole for communicating the accommodating chamber 221 and the suction hole 241 is formed at a position of the auxiliary bearing 22 corresponding to the accommodating chamber 221, and the variable-capacity valve 3 may enter the suction hole 241 via the communication hole to isolate the suction port A from the compression chamber B. The valve base 9 may be assembled to the auxiliary bearing 22 in a sealing manner, and for example, an upper end face of the valve base 9 and the lower end face of the auxiliary bearing 22 are both subjected to finish machining, so as to ensure the sealing between the upper end face of the valve base 9 and the lower end face of the auxiliary bearing 22 when assembled; alternatively, the sealing may be ensured by providing a sealing ring, a gasket or the like between the valve base 9 and the auxiliary bearing 22.

Figure 10:
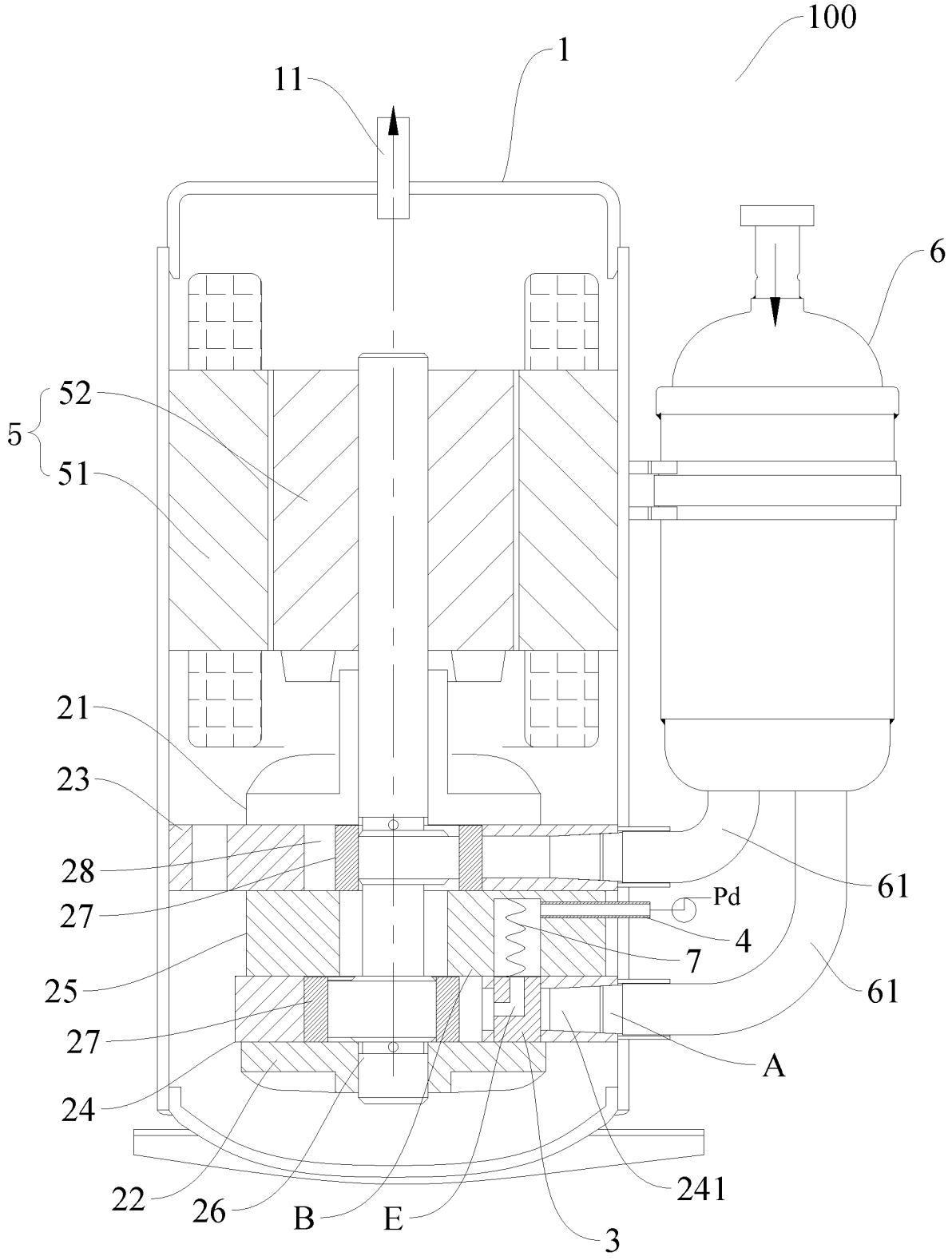
FIG. 10 is a schematic view of a variable-capacity compressor according to an embodiment of the present disclosure, in which a variable-capacity valve is disposed in a partition plate.

For example, in an example of FIG. 10, the variable-capacity valve 3 is disposed in the partition plate 25, and specifically, the accommodating chamber 221 and the pressure supply passage 41 are both formed in the partition plate 25; the pressure supply passage 41 extends in a horizontal direction; the accommodating chamber 221 penetrate a lower end face of the partition plate 25 and is in communication with the suction hole 241 of the variable-capacity cylinder (i.e. the second cylinder 24); the variable-capacity valve 3 is disposed in the accommodating chamber 221 and movable in the up-and-down direction, and may move downward into the suction hole 241 to isolate the suction port A from the compression chamber B. Further, at least one spring 7 is disposed between a top of the variable-capacity valve 3 and a top wall of the accommodating chamber 221, and the spring 7 may be configured to normally push the variable-capacity valve 3 towards the isolation position.

When the first pressure gas is introduced into the accommodating chamber 221, the gas force exerted on an upper end face of the variable-capacity valve 3 overcomes the elastic force of the spring 7 to press the variable-capacity valve 3 into the second cylinder 24 to isolate the suction port A from the compression chamber B, and the compression chamber B is in communication with the pressure supply passage 41 through the first pressure passage E, such that the first pressure gas may enter the compression chamber B, in which case the head and the tail of the sliding vane 29 of the second cylinder 24 are both subjected to the discharge pressure, the sliding vane 29 is held in the sliding vane groove (for example, by means of the above magnetic material member 8), and the head of the sliding vane 29 does not contact the outer circumferential wall of the piston 27, such that the second cylinder 24 is unloaded. When the second pressure gas is introduced into the accommodating chamber 221, the spring 7 overcomes the gravity of the variable-capacity valve 3 to pull the variable-capacity valve 3 into the accommodating chamber 221 of the partition plate 25, the first pressure passage E is sealed by the inner wall of the accommodating chamber 221, and the suction port A is in communication with the compression chamber B through the suction hole 241, such that the low-pressure refrigerant may enter the compression chamber B, and due to the differential pressure between the head and the tail of the sliding vane 29 of the second cylinder 24, the sliding vane 29 may keep abutting against the outer circumferential wall of the piston 27 under the action of the differential pressure, so as to perform the compression of the refrigerant entering the compression chamber B.

Optionally, a displacement (i.e. the capacity) of the variable-capacity cylinder is denoted as q, an overall displacement of the variable-capacity compressor 100 is denoted as Q, in which, q and Q satisfy: $q/Q \leq 50\%$. In the partial capacity work mode, an adjustment of the partial capacity work mode may be achieved by designing a capacity ratio of the first cylinder 23 and the second cylinder 24. For example, if the capacity of the first cylinder 23 is equal to that of the second cylinder 24, i.e. $q/Q=50\%$, in the partial capacity work mode, the variable-capacity compressor 100 operates in a 50% capacity work mode; for another example, if the capacity ratio of the first cylinder 23 to the second cylinder 24 is 6:4, i.e. $q/Q=40\%$, in the partial capacity work mode, the variable-capacity compressor 100 operates in a 60% capacity work mode. It should be understood that, a specific value of q/Q may be specifically set according to the practical requirements, which is not particularly defined by the present disclosure.

The above variable-capacity compressor 100 according to embodiments of the present disclosure, when the variable-capacity cylinder participates in the compression operation, the suction passage of the variable-capacity cylinder is substantially consistent with that of the normally operating cylinder, which is substantially consistent with a suction design of a conventional dual-cylinder rotary compressor, that is, the first suction conduit 61 communicated with the liquid reservoir 6 of the variable-capacity cylinder has the same design as the first suction conduit 61 communicated with the liquid reservoir 6 of the normally operating cylinder, which avoids a problem of increased suction resistance due to additional lengthening of the first suction conduit 61 or installation of a control valve, and reduces the cost; the whole variable-capacity compressor 100 is not easy to generate vibration, such that problems of noise and reliability are avoided. Thus, an efficiency of the variable-capacity cylinder in operation is not affected, so as to ensure the performance of the variable-capacity compressor 100 in the full capacity work mode.

Figure 11:
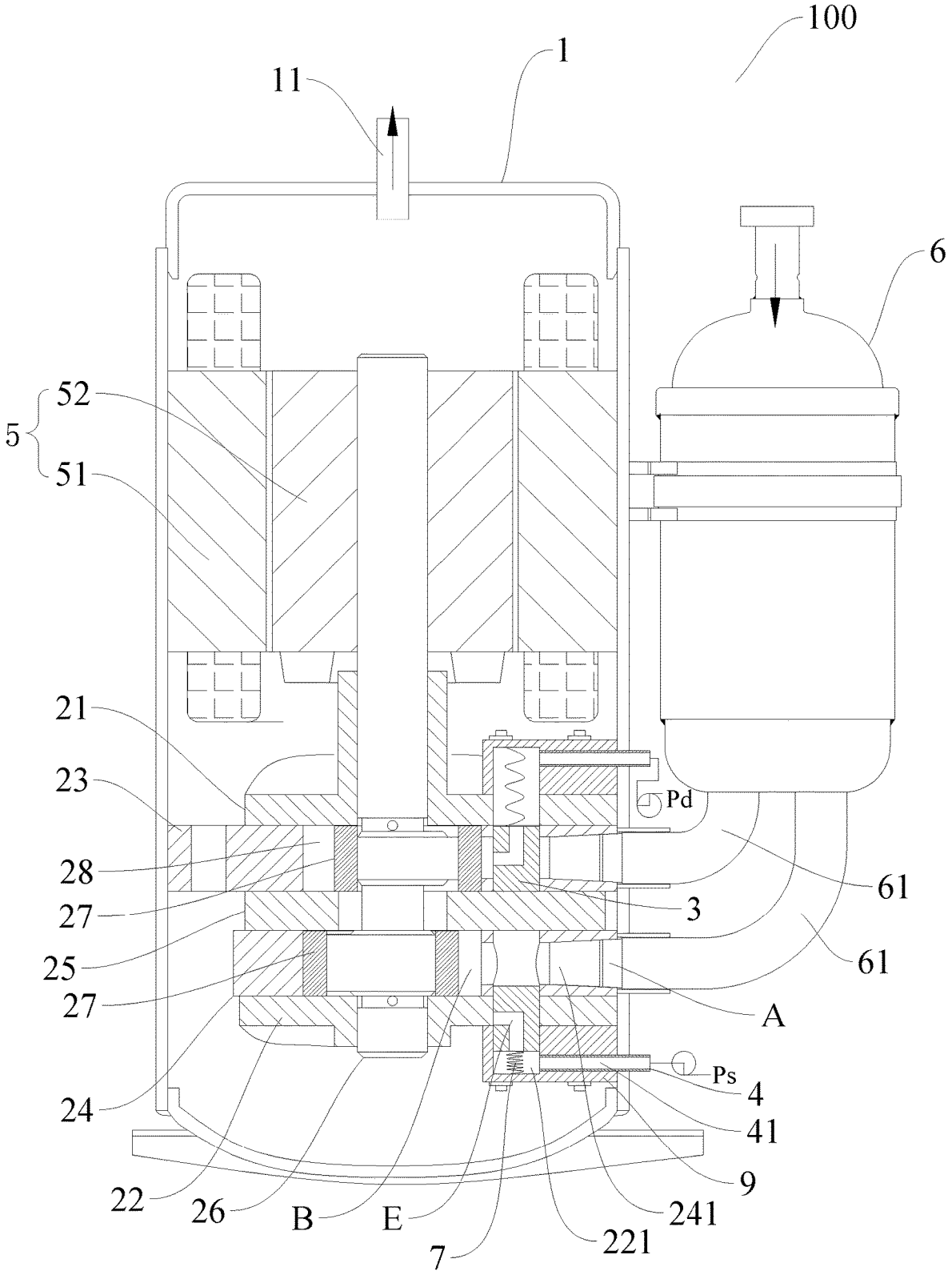
FIG. 11 is a schematic view of a variable-capacity compressor according to an embodiment of the present disclosure, in which a first cylinder and a second cylinder are provided with a variable-capacity valve separately.

The first cylinder 23 and the second cylinder 24 may both be configured as the variable-capacity cylinder, for example, as shown in FIG. 11, in which case two variable-capacity valves 3 are provided, and each of the variable-capacity valves 3 is respectively configured to be movable between the communication position where the compression chamber B of the respective cylinder is communicated with the suction port A of the respective cylinder and the isolation position where the compression chamber B is isolated from the suction port A. Functions and control principles of the two variable-capacity valves 3 are described above, which will not be described in detail herein. It should be noted that, when the first cylinder 23 and the second cylinder 24 are both configured as the variable-capacity cylinder, the first pressure gas may not be introduced into two pressure supply passages 41 simultaneously, that is, the unloading situation may not occur to the two variable-capacity cylinders simultaneously, to ensure that at least one cylinder is in operation at each moment. In such a case, the pressure supply passage 41 may be correspondingly added according to the number of the variable-capacity cylinder.

In this case, there are three specific work modes for the variable-capacity compressor 100 as follows. First, when the second pressure gas is introduced into the pressure supply passage 41 corresponding to the first cylinder 23, and the first pressure gas is introduced into the pressure supply passage 41 corresponding to the second cylinder 24, the first cylinder 23 participates in the compression operation while the second cylinder 24 is unloaded, in which case the variable-capacity compressor 100 operates in the partial capacity work mode, and the capacity of the variable-capacity compressor 100 is the capacity of the first cylinder 23; second, when the first pressure gas is introduced into the pressure supply passage 41 corresponding to the first cylinder 23, and the second pressure gas is introduced into the pressure supply passage 41 corresponding to the second cylinder 24, the first cylinder 23 does not participate in the compression operation while the second cylinder 24 participates in the compression operation, in which case the variable-capacity compressor 100 operates in the partial capacity work mode, and the capacity of the variable-capacity compressor 100 is the capacity of the second cylinder 24; third, when the second pressure gas is introduced into the pressure supply passages 41 corresponding to the first cylinder 23 and the second cylinder 24 simultaneously, the first cylinder 23 and the second cylinder 24 both participate in the compression operation, in which case the variable-capacity compressor 100 operates in the full capacity work mode.

Figure 12A:
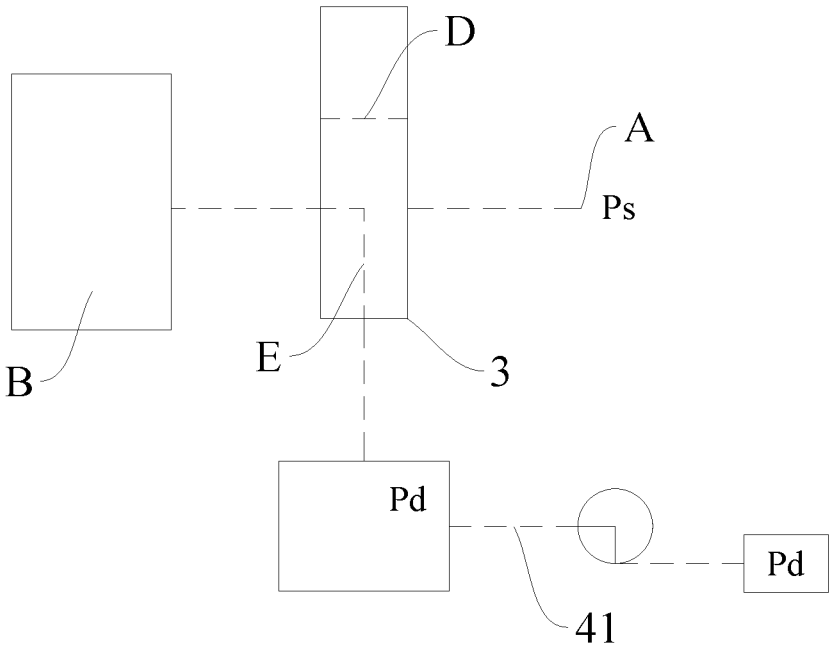
FIG. 12*a* and FIG. 12*b* are schematic views of a variable-capacity principle of a variable-capacity compressor according to another embodiment of the present disclosure, in which a variable-capacity valve of FIG. 12*a* is in an isolation position, and a variable-capacity valve of FIG. 12*b* is in a communication position.
Figure 12B:
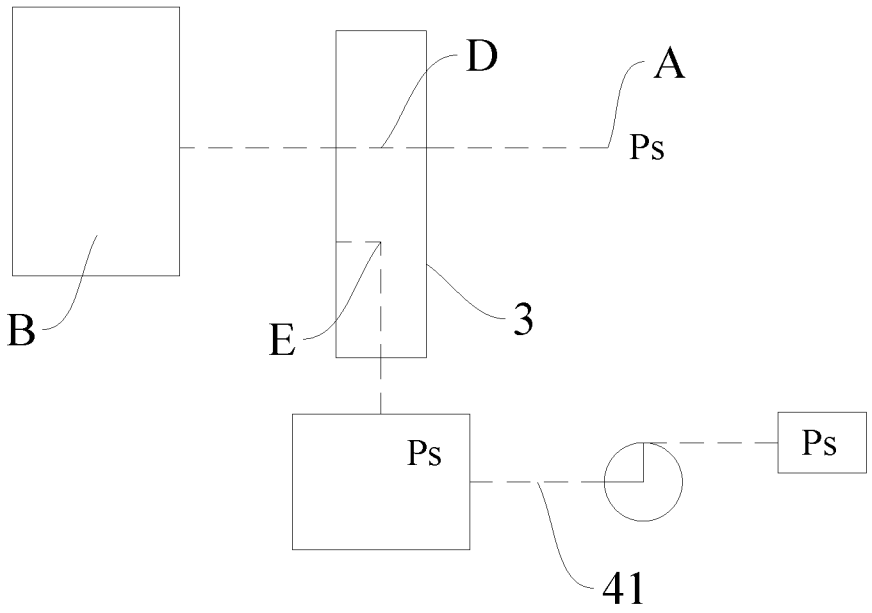

The variable-capacity principle of the variable-capacity compressor 100 according to another embodiment of the present disclosure will be illustrated below in combination with FIGS. 12*a* and 12*b*. FIGS. 12*a* and 12*b* show the suction port A, the compression chamber B of the variable-capacity cylinder, the variable-capacity valve 3, the first pressure passage E and a second pressure passage D formed in the variable-capacity valve 3, and the pressure supply passage 41 (may also be in the form of a conduit segment) communicated with a side of the variable-capacity valve 3, in which the second pressure passage D and the first pressure passage E are not in communication with each other, and when the variable-capacity valve 3 is located in the communication position, the second pressure passage D communicates the compression chamber B with the suction port A. The basic work principle thereof is as follows:

When the first pressure gas (for example, having the discharge pressure Pd) is introduced into the side of the variable-capacity valve 3 (for example, a lower side in FIG. 12*a*) through the pressure supply passage 41, the variable-capacity valve 3 will overcome its own gravity to move upward under the action of the high pressure at the lower end face of the variable-capacity valve 3, such that the second pressure passage D of the variable-capacity valve 3 is staggered with respect to the suction port A and the compression chamber B of the variable-capacity cylinder, and the low pressure at the suction port A cannot be transferred into the compression chamber B, in which case the variable-capacity cylinder cannot suck in the low-pressure refrigerant. Also, after the variable-capacity valve 3 moves upward, the first pressure passage E communicates the pressure supply passage 41 with the compression chamber B, such that the first pressure gas is sucked into the compression chamber B. In this case, since the tail and the head of the sliding vane 29 in the variable-capacity cylinder are both subjected to the discharge pressure, without generating the differential pressure, therefore, the head of the sliding vane 29 is separated from the outer circumferential wall of the piston 27 in the compression chamber B, and the variable-capacity cylinder does not participate in the compression operation. In this case, the compressor operates in the partial capacity work mode.

When the second pressure gas (for example, having the suction pressure Ps) is introduced into the above-described side of the variable-capacity valve 3, the lower end face of the variable-capacity valve 3 is subjected to the low pressure, in which case the variable-capacity valve 3 moves downward under the action of its own gravity, such that the compression chamber B is staggered with respect to the first pressure passage E, while the compression chamber B is in communication with the suction port A through the second pressure passage D, that is, the low-pressure refrigerant enters the compression chamber B of the variable-capacity cylinder through the suction port A and the second pressure passage D. In this case, since the sliding vane chamber 242 maintains the discharge pressure, and the sliding vane 29 is under the action of the differential pressure between the discharge pressure at the tail of the sliding vane 29 and the suction pressure at the head of the sliding vane 29, the head of the sliding vane 29 abuts against the outer circumferential wall of the piston 27, such that the variable-capacity cylinder normally participates in the compression operation. In this case, the variable-capacity compressor 100 operates in the full capacity work mode.

The variable-capacity compressor 100 according to another specific embodiment of the present disclosure will be described below in combination with the above variable-capacity principle and referring to FIG. 13.

Figure 13:
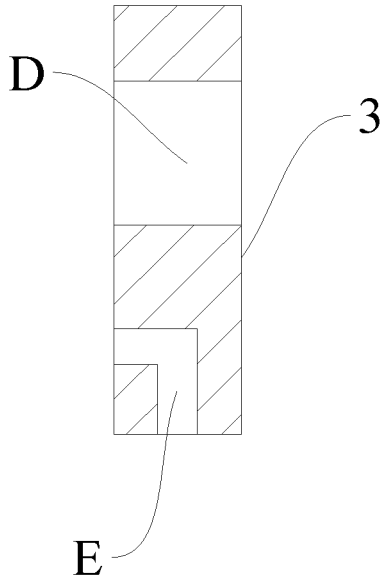
FIG. 13 is a schematic view of a variable-capacity valve according to the said another embodiment of the present disclosure.

As shown in FIG. 13, in the specific embodiment, the first pressure passage E and the second pressure passage D are respectively formed in the variable-capacity valve 3, the first pressure passage E is configured to have the substantially inverted-L shape, and the second pressure passage D is located above the first pressure passage E and extends in the horizontal direction. When the variable-capacity valve 3 is located in the communication position, the suction port A is in communication with the compression chamber B through the second pressure passage D; when the variable-capacity valve 3 is located in the isolation position, the suction port A is isolated from the compression chamber B by the variable-capacity valve 3, and the first pressure gas introduced via the pressure supply passage 41 may enter the compression chamber B through the first pressure passage E, such that the variable-capacity cylinder is unloaded. Optionally, a specific shape and size of the second pressure passage D may be adapted to a shape and size of the suction hole 241, such that the low-pressure refrigerant may be better introduced into the compression chamber B.

Other structures of the variable-capacity compressor 100 according to the specific embodiment may be the same as that of the variable-capacity compressor 100 referring to the description of the above-described embodiment, which will not be described in detail herein.

Figure 14A:
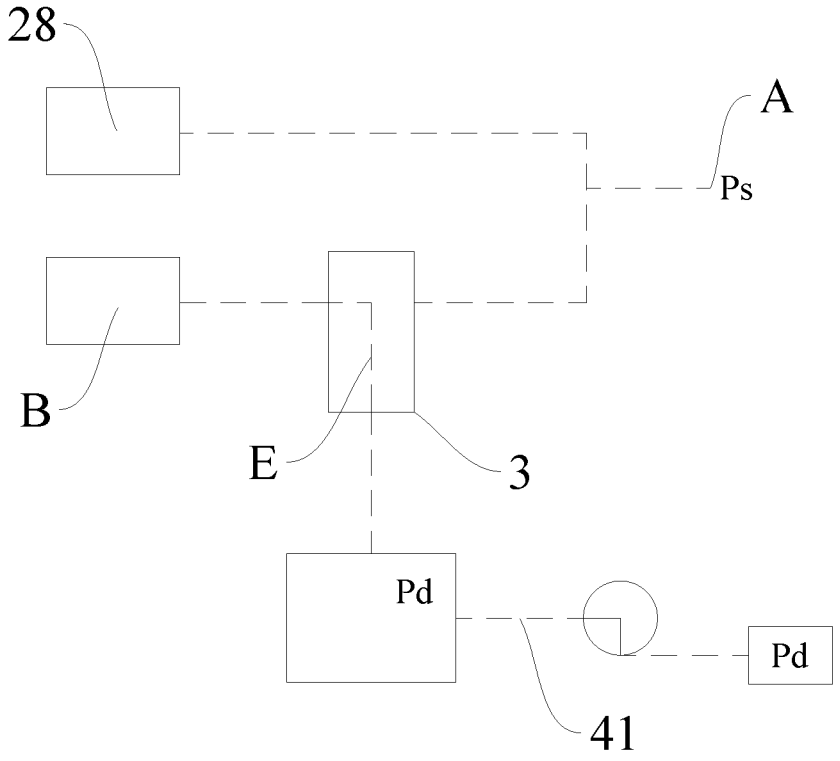
FIG. 14*a* and FIG. 14*b* are schematic views of a variable-capacity compressor according to a further embodiment of the present disclosure, in which a variable-capacity valve of FIG. 14*a* is in an isolation position, and a variable-capacity valve of FIG. 14*b* is in a communication position.
Figure 14B:
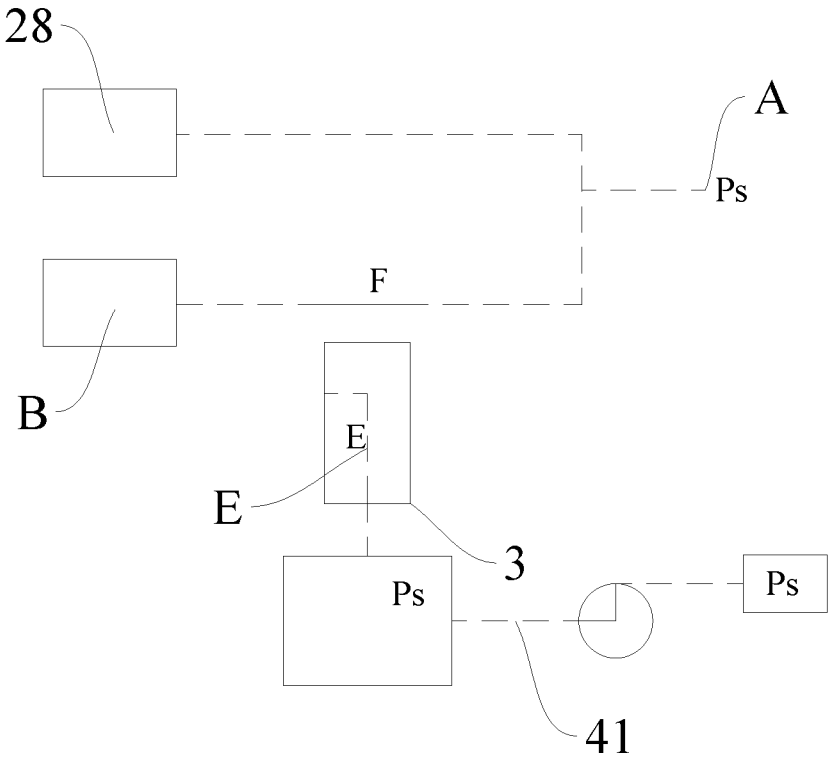

The variable-capacity principle of the variable-capacity compressor 100 according to a further embodiment of the present disclosure will be illustrated below in combination with FIGS. 14*a* and 14*b*. FIGS. 14*a* and 14*b* show the suction port A, the working chamber 28 of the first cylinder 23, the compression chamber B of the variable-capacity cylinder (for example, the second cylinder 24), the variable-capacity valve 3, the first pressure passage E formed in the variable-capacity valve 3, and the pressure supply passage 41 (may also be in the form of a conduit segment) communicating with a side of the variable-capacity valve 3. The present embodiment distinguishes from the above first embodiment only in that the first cylinder 23 and the second cylinder 24 are both connected to the same suction port A. The basic work principle of the variable-capacity compressor 100 of the present embodiment is as follows:

When the first pressure gas (for example, having the discharge pressure Pd) is introduced into one side of the variable-capacity valve 3 (for example, a lower side in FIG. 14*a*), the variable-capacity valve 3 will overcome its own gravity to move upward under the action of the high pressure at the lower end face of the variable-capacity valve 3, such that the variable-capacity valve 3 isolates the suction passage of the variable-capacity cylinder, and the low pressure at the suction port A may not be transferred into the compression chamber B, in which case the variable-capacity valve 3 cannot suck in the low-pressure refrigerant. Also, after the variable-capacity valve 3 moves upward, the first pressure passage E communicates the pressure supply passage 41 with the compression chamber B, such that the first pressure gas in the pressure supply passage 41 is sucked into the compression chamber B. In this case, since the tail and the head of the sliding vane 29 are both subjected to the discharge pressure, without generating the differential pressure, therefore, the head of the sliding vane 29 is separated from the outer circumferential wall of the piston 27, and the variable-capacity cylinder does not participate in the compression operation. In this case, the variable-capacity compressor 100 operates in the partial capacity work mode.

When the second pressure gas (for example, having the suction pressure Ps) is introduced into the above-described side of the variable-capacity valve 3, the lower end face of the variable-capacity valve 3 is subjected to the low pressure, in which case the variable-capacity valve 3 moves downward under the action of its own gravity, such that the compression chamber B is staggered with respect to the first pressure passage E in the up-and-down direction, and the compression chamber B is re-communicated with the suction port A previously blocked by the variable-capacity valve 3, in which case the variable-capacity cylinder may normally suck in the low-pressure refrigerant. In this case, the sliding vane 29 is under the action of the differential pressure between the discharge pressure at the tail of the sliding vane 29 and the suction pressure at the head of the sliding vane 29, and the head of the sliding vane 29 abuts against the outer circumferential wall of the piston 27, such that the variable-capacity cylinder normally participates in the compression operation. In this case, the variable-capacity compressor 100 operates in the full capacity work mode.

In the above process, the first cylinder 23 is configured as the normally operating cylinder, i.e. regardless of the state of the second cylinder 24, the first cylinder 23 operates normally, that is, performs the compression of the low-pressure refrigerant sucked into the working chamber 28 via the suction port A.

The variable-capacity compressor 100 according to a further specific embodiment of the present disclosure will be described below in combination with the above variable-capacity principle and referring to FIGS. 15 to 20.

In the specific embodiment, the first cylinder 23 and the second cylinder 24 are both connected to a second suction conduit 62 (i.e. the suction conduit). Thus, the refrigerant to be compressed from the liquid reservoir 6 (i.e. the low-pressure refrigerant) is introduced into the working chambers 28 of the first cylinder 23 and the second cylinder 24 separately through the second suction conduit 62. For example, as shown in FIG. 15, the suction port A is formed in the partition plate 25, the second suction conduit 62 is connected between the liquid reservoir 6 and the partition plate 25, and the suction port A is in communication with the suction pressure all the time.

Figure 15:
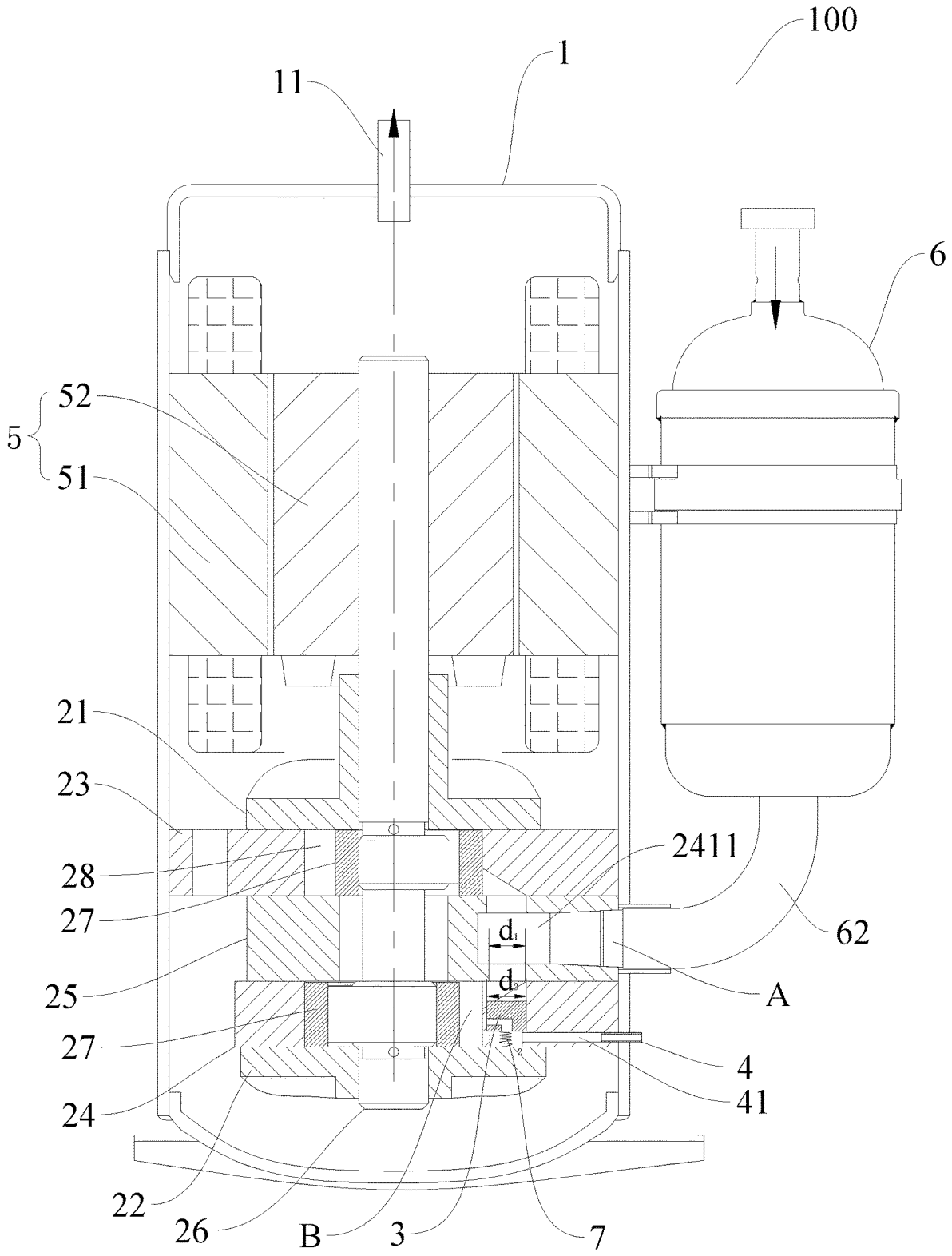
FIG. 15 is a schematic view of a variable-capacity compressor according to the said further embodiment of the present disclosure, in which the variable-capacity valve is in an isolation position.
Figure 16:
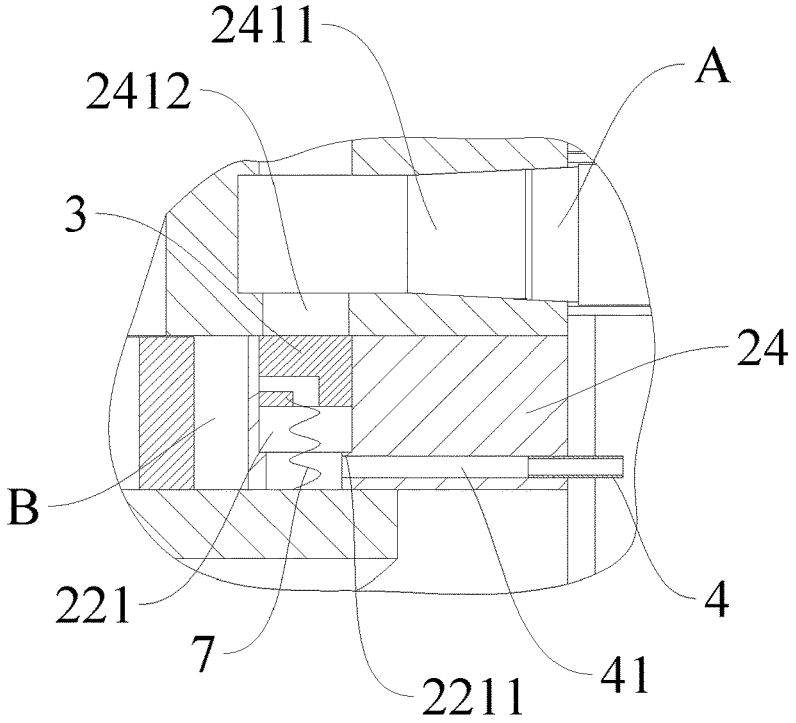
FIG. 16 is a partial view of the variable-capacity compressor shown in FIG. 15, in which the variable-capacity valve is in a communication position.

Referring to FIG. 15 in combination with FIG. 16, the suction hole 241 is formed in the partition plate 25, and the suction port A is configured to be in communication with the working chambers 28 of the first cylinder 23 and the second cylinder 24 through the suction hole 241. Specifically, the suction hole 241 includes a first suction segment 2411 and a second suction segment 2412 connected to each other, in which, the first suction segment 2411 extends in an inner and outer direction of the partition plate 25 (for example, in a radial direction of the partition plate 25), and a first end of the first suction segment 2411 (for example, a right end thereof in FIGS. 15 and 16) penetrates the outer circumferential wall of the partition plate 25 to constitute the suction port A; the second suction segment 2412 is connected to a second end of the first suction segment 2411 (for example, a left end thereof in FIGS. 15 and 16) and extends in an axial direction of the partition plate 25, and a first end of the second suction segment 2412 (for example, a lower end thereof in FIGS. 15 and 16) penetrates the lower end face of the partition plate 25 and is in communication with the accommodating chamber 221 for accommodating the variable-capacity valve 3. Further, the communication holes in communication with the second suction segment 2412 of the suction hole 241 are formed in inner walls of the working chambers 28 of the first cylinder 23 and the second cylinder 24. Optionally, the communication hole is configured as an oblique incision. The pressure supply passage 41 is formed in the second cylinder 24.

As shown in FIG. 15, when the second pressure gas is introduced to the lower end face of the variable-capacity valve 3 through the pressure supply passage 41, the variable-capacity valve 3 is retracted to the lower part of the accommodating chamber 221 under the action of the spring 7 and the gravity, and the variable-capacity valve 3 avoids the communication hole, in which case the compression chamber B of the variable-capacity cylinder (i.e. the second cylinder 24) is in communication with the suction port A through the communication hole and the suction hole 241, and the compression chamber B sucks in the low-pressure refrigerant. Since the tail of the sliding vane 29 of the second cylinder 24 is in communication with the inner space of the housing 1 all the time, the head of the sliding vane 29 will abut against the outer circumferential wall of the piston 27 in the second cylinder 24 under the action of the pressure at the tail thereof, and the variable-capacity cylinder participates in the compression operation, in which case the variable-capacity compressor 100 operates in the dual-cylinder work mode, and the working capacity is the full capacity. When the first pressure gas is introduced to the lower end face of the variable-capacity valve 3 through the pressure supply passage 41, the variable-capacity valve 3 overcomes its own gravity and the force of the spring 7 under the action of the pressure at the lower end thereof, and enters an upper part of the accommodating chamber 221 to close the second suction segment 2412, so as to isolate the communication hole from the second suction segment 2412, that is, to isolate the communication between the compression chamber B of the second cylinder 24 and the suction port A of the partition plate 25, as shown in FIG. 16, in which case the first pressure passage E in the variable-capacity valve 3 is in communication with the compression chamber B through the communication hole, the first pressure gas introduced via the pressure supply passage 41 may enter the compression chamber B of the second cylinder 24 through the first pressure passage E, and the head and the tail of the sliding vane 29 are both subjected to the discharge pressure, without generating the differential pressure, such that the head of the sliding vane 29 is separated from the piston 27, and the second cylinder 24 does not participate in the compression operation, in which case the variable-capacity compressor 100 operates in the partial capacity work mode.

Figure 17A:
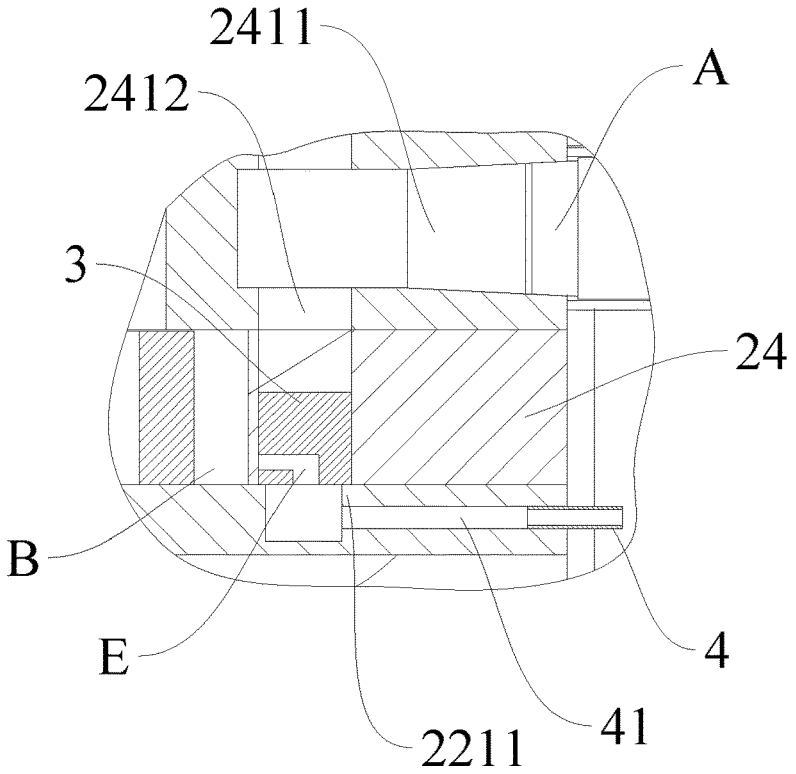
FIG. 17*a* and FIG. 17*b* are schematic views of a variable-capacity compressor according to the said further embodiment of the present disclosure, in which a variable-capacity valve of FIG. 17*a* is in an isolation position, a variable-capacity valve of FIG. 17*b* is in a communication position, and the respective variable-capacity valve in FIG. 17*a* and FIG. 17*b* is not provided with a spring.

In an example of FIGS. 17*a* and 17*b*, the pressure supply passage 41 is formed in the auxiliary bearing 22, the pressure supply passage 41 is located below the accommodating chamber 221 and a section area of an end of the pressure supply passage 41 connected to the accommodating chamber 221 is smaller than that of the accommodating chamber 221, and the first pressure gas or the second pressure gas supplied via the pressure supply passage 41 may act directly on the lower end face of the variable-capacity valve 3 all the time, such that the variable-capacity valve 3 may smoothly move upward and downward in the accommodating chamber 221. In this case, the spring 7 may not be disposed between the variable-capacity valve 3 and the inner wall of the accommodating chamber 221.

A diameter of a minimum circumcircle of the second suction segment 2412 is denoted as $d_1$, and a sectional shape of the variable-capacity valve 3 may be polygonal, such as a square or the like. When the sectional shape of the variable-capacity valve 3 is the square, a width of the variable-capacity valve 3 is denoted as s, in which, s and $d_1$ satisfy: $s>d_1$, such that the variable-capacity valve 3 may completely seal the suction hole 241.

Figure 20:
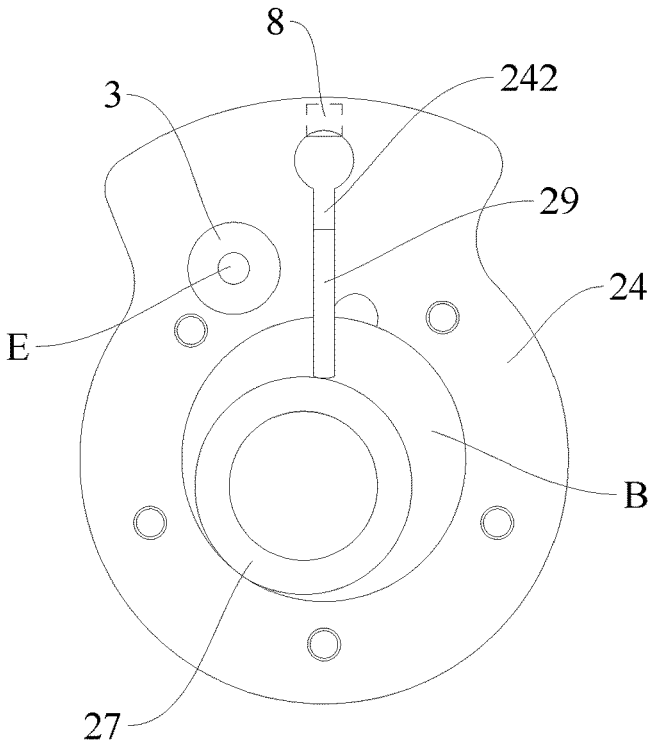
FIG. 20 is a schematic view of a variable-capacity cylinder according to the said further embodiment of the present disclosure.

Certainly, the shape of the variable-capacity valve 3 may be cylindrical, as shown in FIG. 20, a diameter of the variable-capacity valve 3 is denoted as $d_2$, in which, $d_1$ and $d_2$ satisfy: $d_2>d_1$. Further, $d_1$ and $d_2$ satisfy: $d_2\geq d_1+0.5$ mm. Further, $d_1$ and $d_2$ satisfy: $d_2\geq d_1+1$ mm. And further, $d_1$ and $d_2$ may also satisfy: $d_2\geq d_1+2$ mm. Thus, the end face of the variable-capacity valve 3 may abut against the corresponding end face of the partition plate 25, so as to achieve the sealed isolation between the second suction segment 2412 and the compression chamber B.

Figure 17B:
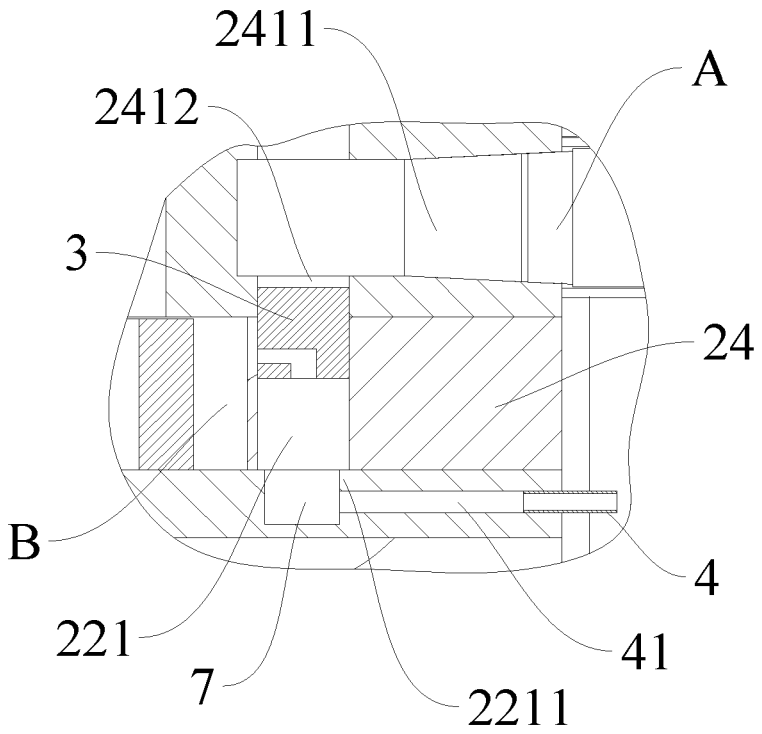

Further, as shown in FIG. 17*b*, when the variable-capacity valve 3 is located in the isolation position, the variable-capacity valve 3 is configured to enter the second suction segment 2412, in which case the sectional shape of the second suction segment 2412 may be circular, correspondingly, the shape of the variable-capacity valve 3 is cylindrical, the variable-capacity valve 3 is fitted with an inner wall of the second suction segment 2412 in the circumferential direction to achieve the sealed isolation. Further, a limiting member such as the spring 7 or the like may be provided, so as to prevent the variable-capacity valve 3 from entering the suction hole 241 completely.

Figure 18:
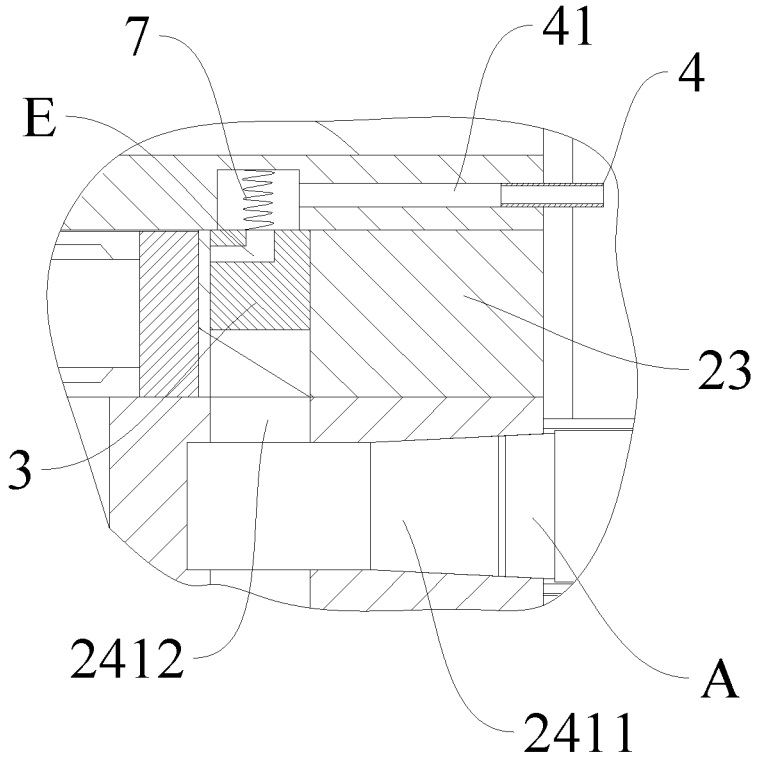
FIG. 18 is a schematic view of a variable-capacity compressor according to the said further embodiment of the present disclosure, in which a variable-capacity valve is disposed in a partition plate.

As shown in FIG. 18, the first cylinder 23 is configured as the variable-capacity cylinder, and the pressure supply passage 41 is formed in the main bearing 21. FIG. 18 distinguishes from FIGS. 15 and 16 only in that the effect of the spring 7 is reversed. Specifically, when the second pressure gas is introduced into the pressure supply passage 41, the spring 7 will overcome the gravity of the variable-capacity valve 3 to pull the variable-capacity valve 3 upward, such that the first cylinder 23 sucks air normally; when the first pressure gas is introduced into the pressure supply passage 41, the gas force exerted on the upper end face of the variable-capacity valve 3 will overcome the elastic force of the spring 7 and the gravity of the variable-capacity valve 3 to press the variable-capacity valve 3 downward, so as to isolate the suction of the first cylinder 23.

Figure 19:
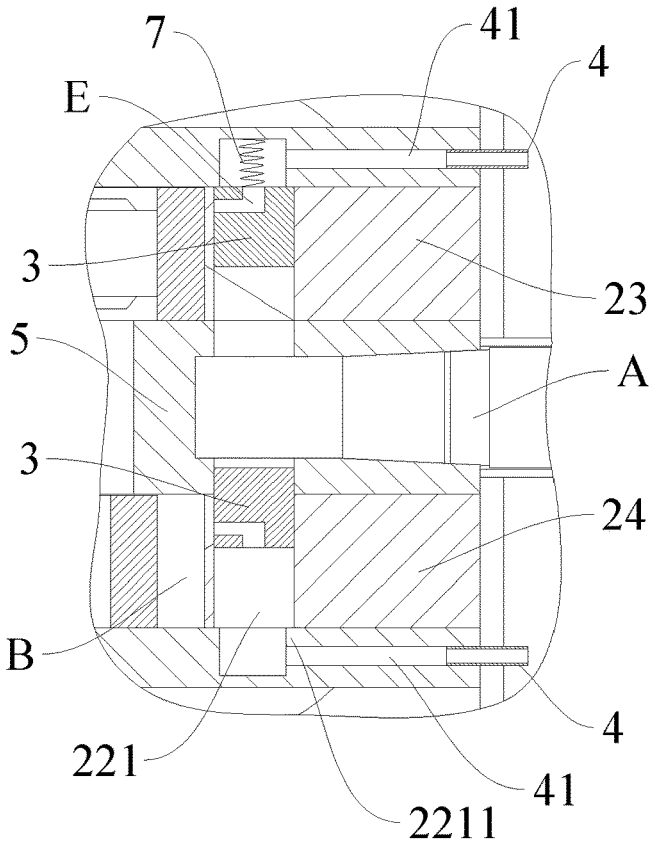
FIG. 19 is a schematic view of a variable-capacity compressor according to the said further embodiment of the present disclosure, in which a first cylinder and a second cylinder are provided with a variable-capacity valve separately.

The first cylinder 23 and the second cylinder 24 as shown in FIG. 19 are both configured as the variable-capacity cylinders, correspondingly, two variable-capacity valves 3 are provided, and the two variable-capacity valves 3 are respectively disposed in the respective cylinder. Functions and control principles of the two variable-capacity valves 3 are described above, which will not be described in detail herein.

Other structures of the variable-capacity compressor 100 according to the specific embodiment may be same as that of the variable-capacity compressor 100 referring to the description of the above-described embodiment, which will not be described in detail herein.

For the variable-capacity compressor 100 according to embodiments of the present disclosure, the variable-capacity valve 3 is designed in the housing 1, and when the variable-capacity valve 3 participates in the compression operation, the suction path thereof is substantially consistent with that of the conventional dual-cylinder compressor, that is, since a structure of the suction path is not changed, a suction efficiency of the variable-capacity cylinder is substantially unaffected, such that an operating efficiency of the variable-capacity cylinder is not affected, and the performance of the variable-capacity cylinder may be well ensured.

Furthermore, the problem of increased suction resistance due to additional lengthening of the first suction conduit 61 or the installation of the control valve is avoided, meanwhile the cost is reduced, and the whole variable-capacity compressor 100 is not easy to generate vibration, such that problems of noise and reliability are avoided. Furthermore, since the sliding vane chamber 242 of the variable-capacity cylinder is in direct communication with the interior of the housing 1, not only the structure of the sliding vane chamber 242 is simplified, but also the sliding vane 29 may directly contact the lubrication oil in the oil sump at the bottom of the housing 1 through the sliding vane chamber 242, such that the sliding vane 29 has a good lubrication effect, so as to ensure the reliability and the performance of the variable-capacity compressor 100 over a long period of operation. In addition, the variable-capacity compressor 100 according to the present disclosure has characteristics of simple and reasonable structure, low manufacturing cost, and high control reliability.

As shown in FIGS. 21 to 24, the refrigeration device 200 according to the second aspect of embodiments of the present disclosure includes a first heat exchanger 201, a second heat exchanger 202, a first control valve 203 and the variable-capacity compressor 100. The variable-capacity compressor 100 may be configured as a variable-capacity compressor 100 described referring to the embodiments of the first aspect. The refrigeration device 200 may be applied in an air conditioner, and the air conditioner is usually used to keep the indoor environment in a comfortable state by keeping the indoor temperature at a set temperature. Optionally, the first control valve 203 is configured as a four-way valve, but is not limited thereto.

Specifically, a first end of the second heat exchanger 202 (for example, a right end thereof in FIGS. 21 and 22) is connected to a first end of the first heat exchanger 201 (for example, a right end thereof in FIGS. 21 and 22); the first control valve 203 includes a first valve port 2031, a second valve port 2032, a third valve port 2033 and a fourth valve port 2034; the first valve port 2031 is connected to a second end of the first heat exchanger 201 (for example, a left end thereof in FIGS. 21 and 22); and the third valve port 2033 is connected to a second end of the second heat exchanger 202 (for example, a left end thereof in FIGS. 21 and 22), in which an exhaust port 11 (may be in the form of a conduit segment) is formed in the housing 1 of the variable-capacity compressor 100, the exhaust port 11 is used for discharging the compressed refrigerant in the housing 1 and connected to the fourth valve port 2034, the suction port A is connected to the second valve port 2032, and the pressure supply passage 41 is connected to the suction port A or the exhaust port 11 to introduce the low-pressure refrigerant having the suction pressure Ps (i.e. the second pressure gas) or the high-pressure refrigerant having the discharge pressure Pd (i.e. the first pressure gas) into the pressure supply passage 41.

Further, a throttling element 204 is disposed between the first end of the first heat exchanger 201 and the first end of the second heat exchanger 202. Optionally, the throttling element 204 is configured as a capillary or an expansion valve.

One of the first heat exchanger 201 and the second heat exchanger 202 is configured as a condenser, and the other is configured as an evaporator. The variable-capacity compressor 100 is used to compress the refrigerant. The condenser is used to condense the refrigerant compressed by the compressor and release the heat outwards. The throttling element 204 is used to reduce the pressure of the refrigerant condensed by the condenser. The evaporator is used to evaporate the refrigerant which has passed through the throttling element 204, and absorb the external heat.

Figure 21:
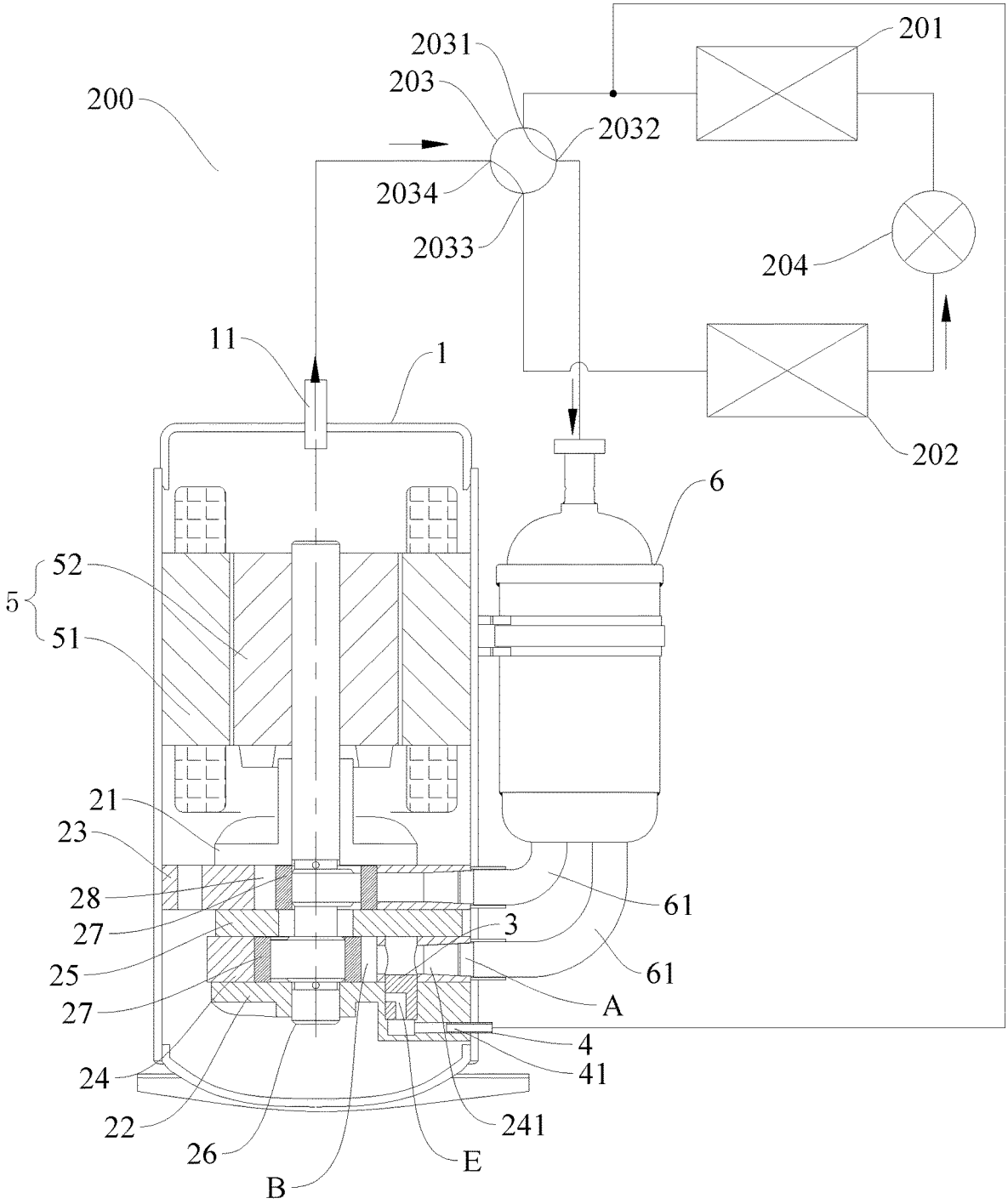
FIG. 21 and FIG. 22 are schematic views of a refrigeration device according to an embodiment of the present disclosure, in which a refrigeration device of FIG. 21 operates in a heating status, and a refrigeration device of FIG. 22 operates in a refrigerating status.
Figure 22:
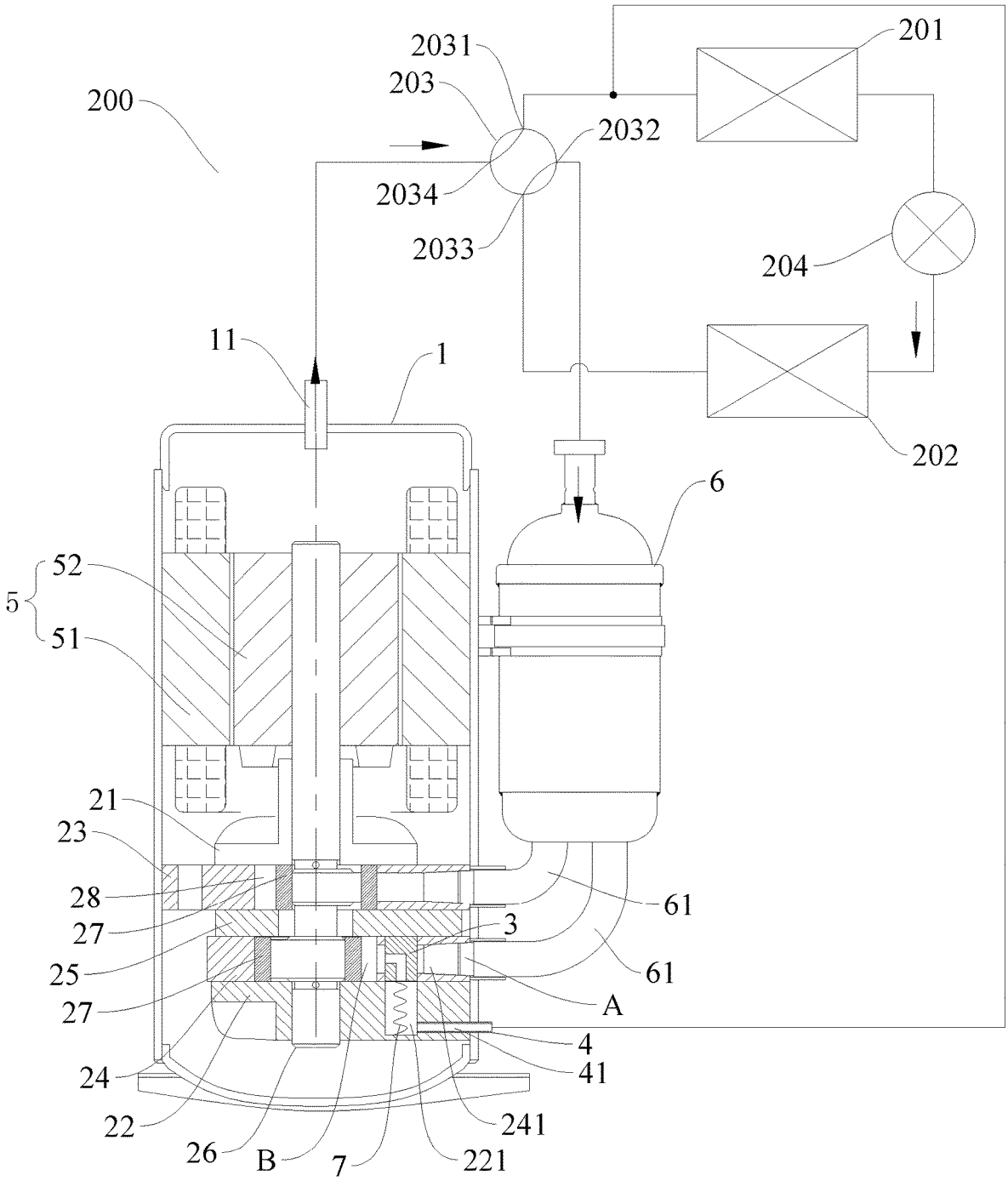

According to an operating mode of the refrigeration device 200, a refrigerating mode that the second heat exchanger 202 is in communication with the suction port A of the variable-capacity compressor 100 and meanwhile the first heat exchanger 201 is in communication with the exhaust port 11 of the variable-capacity compressor 100 can be achieved (as shown in FIG. 22); a heating mode that the second heat exchanger 202 is in communication with the exhaust port 11 of the variable-capacity compressor 100 and meanwhile the first heat exchanger 201 is in communication with the suction port A can also be achieved (as shown in FIG. 21).

In an example of FIGS. 21 and 22, the liquid reservoir 6 is connected to the first cylinder 23 and the second cylinder 24 of the variable-capacity compressor 100 through two first suction conduits 61 respectively. The first end of the pressure supply passage 41 is disposed between the first valve port 2031 of the first control valve 203 and the second end of the first heat exchanger 201, and for example, the pressure supply passage 41 of the variable-capacity compressor 100 is connected to a pipe between the first control valve 203 and the second heat exchanger 202, such that when the refrigeration device 200 operates in the refrigerating mode, the high-pressure refrigerant is introduced into the pressure supply passage 41; when the refrigeration device 200 operates in the heating mode, the low-pressure refrigerant is introduced into the pressure supply passage 41. The second cylinder 24 is configured as the variable-capacity cylinder.

FIG. 22 is a schematic view of the refrigeration device 200 operating in the refrigerating mode. The exhaust port 11 of the variable-capacity compressor 100 is connected to the first heat exchanger 201 through the first control valve 203, the second heat exchanger 202 is connected to the suction port A of the variable-capacity compressor 100 through the first control valve 203, in which case the pressure supply passage 41 introduces the high-pressure refrigerant to the lower end face of the variable-capacity valve 3, and the variable-capacity valve 3 moves upward into the suction hole 241 under the action of the high pressure at the lower end face of the variable-capacity valve 3 and isolates the suction port A from the compression chamber B, such that the variable-capacity cylinder cannot suck in the low-pressure refrigerant from the liquid reservoir 6; furthermore, the compression chamber B of the variable-capacity cylinder may be in communication with the high pressure of the pressure supply passage 41 through the first pressure passage E of the variable-capacity valve 3, in which case the head and the tail of the sliding vane 29 in the variable-capacity cylinder are both subjected to the discharge pressure, without generating the differential pressure, so the head of the sliding vane 29 is separated from the piston 27 in the variable-capacity cylinder, and the variable-capacity cylinder is unloaded and does not participate in the compression operation, in which case the variable-capacity compressor 100 operates in the partial capacity work mode.

FIG. 21 is a schematic view of the refrigeration device 200 operating in the heating mode. The exhaust port 11 of the variable-capacity compressor 100 is connected to the second heat exchanger 202 through the first control valve 203, and the first heat exchanger 201 is connected to the suction port A of the variable-capacity compressor 100 through the first control valve 203, in which case the pressure supply passage 41 introduces the low-pressure refrigerant to the lower end face of the variable-capacity valve 3, and without the differential pressure between the upper end and the lower end of the variable-capacity valve 3, the variable-capacity valve 3 leaves the suction hole 241 under the action of its own gravity, in which case the compression chamber B of the variable-capacity cylinder may suck in the low-pressure refrigerant from the liquid reservoir 6 through the suction hole 241. Since the tail of the sliding vane 29 is in communication with the discharge pressure of the inner space of the housing 1, the head of the sliding vane 29 abuts against the outer circumferential wall of the corresponding piston 27 under the action of the pressure at the tail, and the variable-capacity cylinder operates, in which case the variable-capacity compressor 100 operates in the dual-cylinder and full capacity work mode. Thus, when the refrigeration device 200 operates in different modes, the variable-capacity compressor 100 may operate in respective capacities.

When the refrigeration device 200 is refrigerating, the variable-capacity cylinder does not operate; however, when the refrigeration device 200 is heating, the variable-capacity cylinder operates, such that the variable-capacity compressor 100 operates in a large capacity mode, the heating capacity of the refrigeration device 200 is improved, and particularly at a low ambient temperature, the heating capacity of the refrigeration device 200 is effectively ensured by operating in the large capacity mode. Furthermore, in this mode, the structure of the refrigeration system is simple, and the heating capacity may be improved without additional control. In addition, since the variable-capacity compressor 100 has the normally operating cylinder and the variable-capacity cylinder at the same time, the structure and control of the variable-capacity compressor 100 may be simplified.

Figure 23:
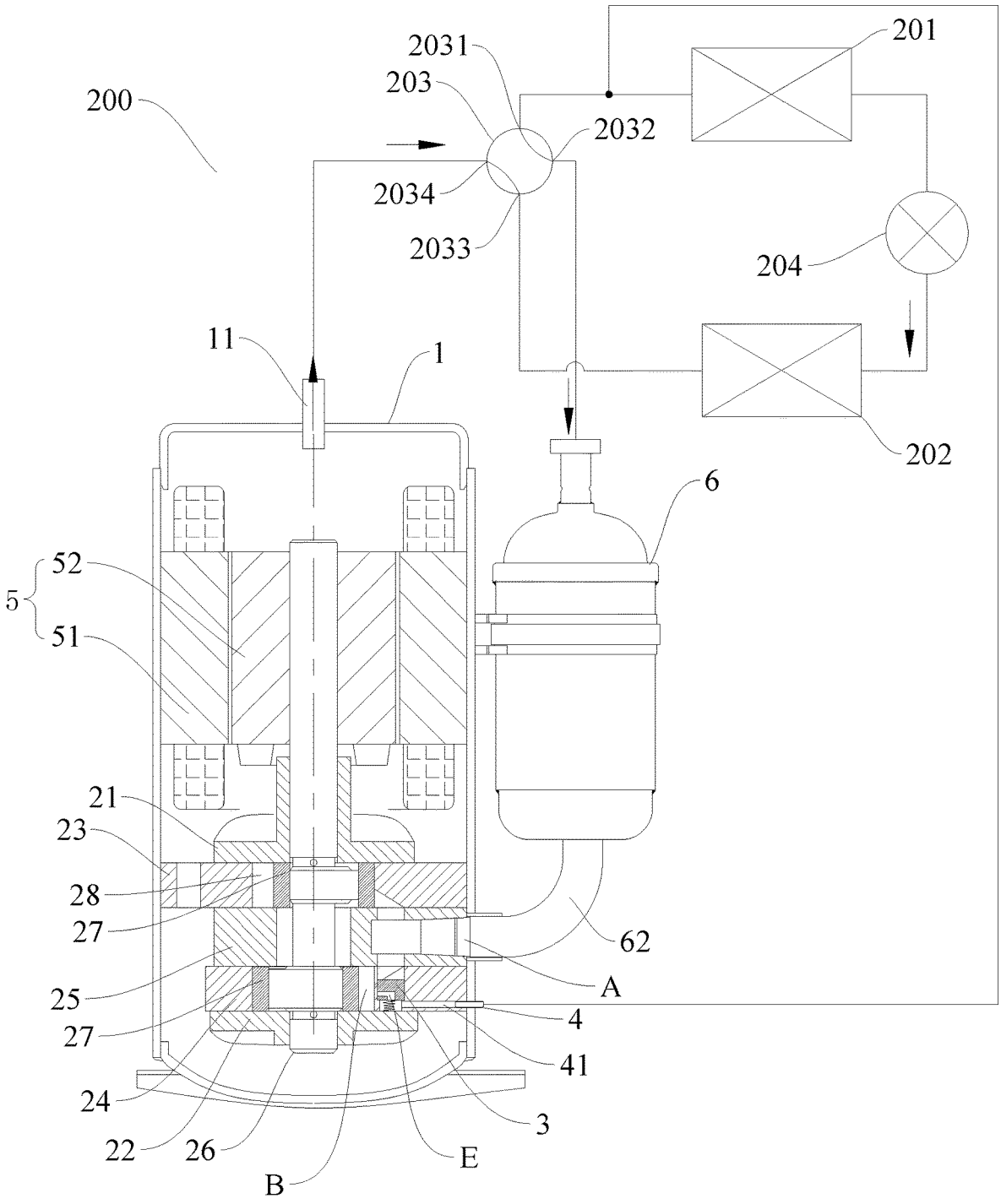
FIG. 23 is a schematic view of a refrigeration device according to another embodiment of the present disclosure.

The refrigeration device 200 in FIG. 23 distinguishes from the refrigeration device 200 in FIGS. 21 and 22 only in that the liquid reservoir 6 is connected to the first cylinder 23 and the second cylinder 24 only through one second suction conduit 62. Structures and work principles of other components of the refrigeration device 200 of FIG. 23 is substantially the same as the corresponding structure and work principle of the refrigeration device 200 of FIGS. 21 and 22, which will not be described in detail herein.

Figure 24:
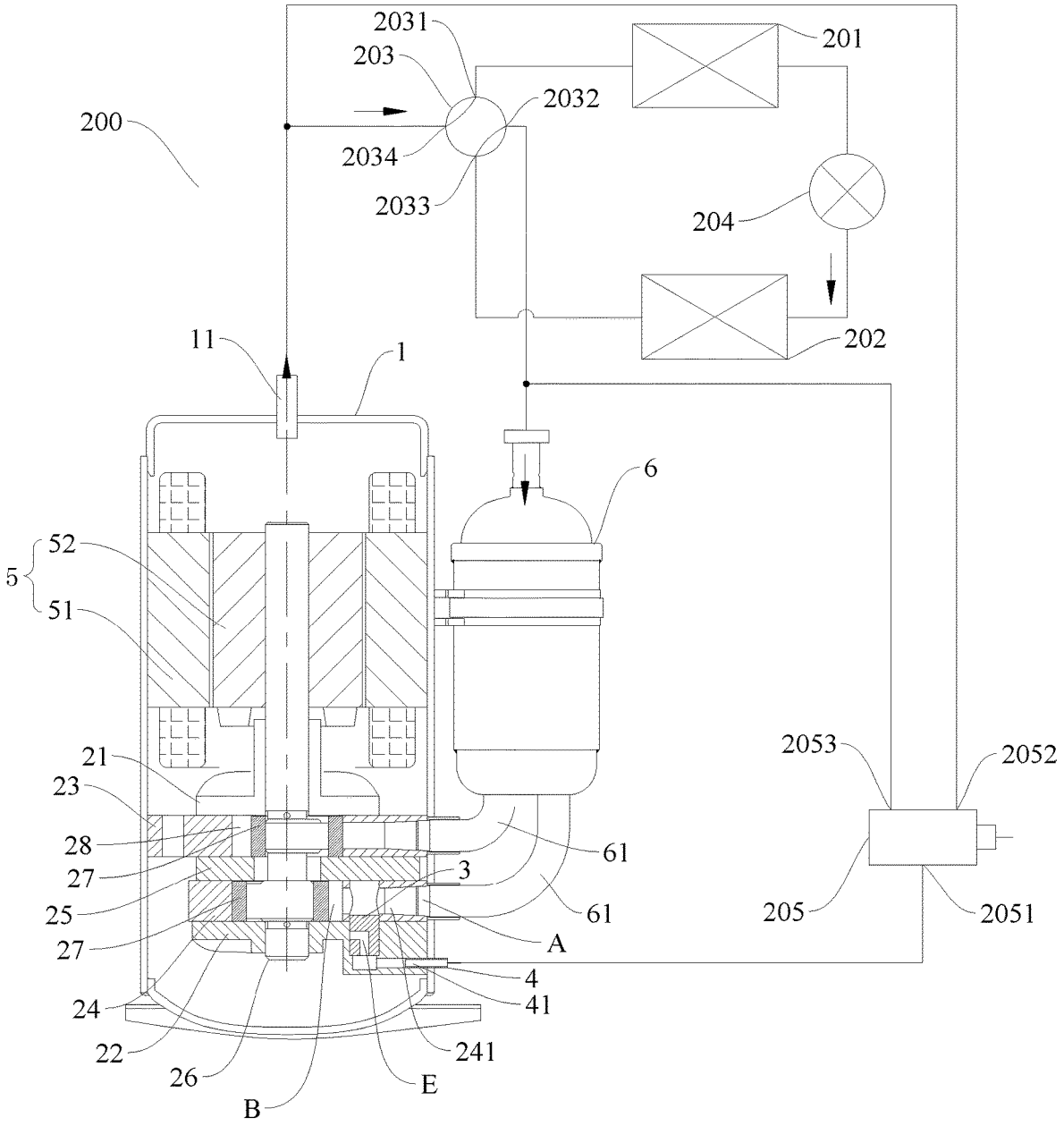
FIG. 24 is a schematic view of a refrigeration device according to a further embodiment of the present disclosure.

As shown in FIG. 24, the refrigeration device 200 further includes a second control valve 205; the second control valve 205 includes a first port 2051, a second port 2052 and a third port 2053; the first port 2051 is connected to the first end of the pressure supply passage 41, the second port 2052 is connected to the exhaust port 11, and the third port 2053 is connected to the suction port A. The first port 2051 is selectively connected to the second port 2052 or the third port 2053. Optionally, the second control valve 205 is a three-way valve, but is not limited thereto. Regardless of whether the refrigeration device 200 operates in the heating mode or in the refrigerating mode, as long as the first port 2051 is in communication with the second port 2052, the variable-capacity valve 3 will isolate the suction port A from the compression chamber B to unload the variable-capacity cylinder, but as long as the first port 2051 is in communication with the third port 2053, the suction port A will be in communication with the compression chamber B to make the variable-capacity cylinder operate.

Thus, by providing the second control valve 205, whether variable-capacity cylinder operates may be controlled according to practical requirements of the refrigeration device 200, such that a flexible control of the variable-capacity cylinder may be achieved. For example, a large capacity work mode when in the refrigerating mode and a small capacity work mode when in the heating mode may be achieved. For the refrigeration device 200, by making the operating mode of the refrigeration device 200 more flexible, the flexible control of capacity or power of the refrigeration device 200 may be achieved, that is, according to the load requirement of the refrigeration device 200, the variable-capacity compressor 100 may operate under a corresponding load, achieving efficient operation.

It should be noted that, since the pressure introduced into the second control valve 205 is a control pressure of the variable-capacity valve 3, a fluid path of the second control valve 205 may be designed to be small, as long as transfer of the pressure may be achieved. For example, a flow area of the first port 2051 may be smaller than that of an input end of the first heat exchanger 201. Further, the first port 2051 and the input end of first heat exchanger 201 are connected to corresponding components respectively through pipes, the flow area (may also be a circulation area or a sectional area) of the pipe of the input end of the first heat exchanger 201 is denoted as S1, the sectional area (may also be a circulation area or a flow area) of the pipe of the second control valve 205 connected to the pressure supply passage 41 is denoted as S2, and it may be designed as S2<S1. Thus, since the second control valve 205 only needs to supply pressure to the variable-capacity valve 3, a size of the second control valve 205 may be designed to be small, and in the terms of function, size and cost, there are significant improvements. Herein, "the input end of the first heat exchanger 201" may be understood as an inlet end when the refrigerant flows through the first heat exchanger 201. For example, when the refrigeration device 200 is refrigerating (a situation as shown in FIG. 24), the input end of the first heat exchanger 201 is a left end in FIG. 24, and correspondingly, when the refrigeration device 200 is heating, the input end of the first heat exchanger 201 is a right end in FIG. 24.

In addition, a size of the pressure supply passage 41 of the variable-capacity compressor 100 may be designed to be small, as long as the pressure supply may be achieved. For example, the sectional area of the pressure supply passage 41 is smaller than that of the input end of the first heat exchanger 201. Specifically, the compression mechanism is provided with the pressure supply conduit 4, and the pressure supply passage 41 is defined in the pressure supply conduit 4; a pipe diameter of the pressure supply conduit 4 is smaller than that of the input end of the first heat exchanger 201, and respective sectional shapes of the pressure supply conduit 4 and the pipe of the input end of the first heat exchanger 201 are preferably circular; the pipe diameter of the pressure supply conduit 4 is denoted as R, and the pipe diameter of the input end of the first heat exchanger 201 is denoted as T, in which it may be designed as R<T.

The refrigeration device 200 according to embodiments of the present disclosure improves an overall performance of the refrigeration device 200, and has characteristics of simple structure, easy control, and being reliable and easy to use.

Other configurations and operations of the variable-capacity compressor 100 and the refrigeration device 200 according to embodiments of the present disclosure are well known to a person skilled in the art, which will not be described in detail herein.

Reference throughout this specification to "an embodiment," "some embodiments," "illustrative embodiment", "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments of the present disclosure have been shown and described, it would be appreciated by those skilled in the art that changes, modifications, alternatives, and variations can be made in the embodiments without departing from spirit, principles of the present disclosure, and the scope of the present disclosure is defined by the claims and their equivalents.

What is claimed is:

1. A variable-capacity compressor, comprising:

a housing;

a compression mechanism disposed in the housing and comprising two bearings and a cylinder assembly disposed between the two bearings;

wherein: the cylinder assembly comprises a first cylinder and a second cylinder, the first cylinder and the second cylinder are each configured as a variable-capacity cylinder, and the first cylinder comprises a first compression chamber and a first suction port and the second cylinder comprises a second compression chamber and a second suction port;

two first suction conduits connected to the first cylinder and the second cylinder respectively; and a first variable-capacity valve associated with the first cylinder and configured to be movable between a communication position where the first compression chamber is in fluid communication with the first suction port and an isolation position where the first compression chamber is isolated from the first suction port;

a second variable-capacity valve associated with the second cylinder and configured to be movable between a communication position where the second compression chamber is in fluid communication with the second suction port and an isolation position where the second compression chamber is isolated from the second suction port;

a first pressure supply passage in fluid communication with the first variable-capacity valve for supplying a first pressure gas or a second pressure gas, wherein a pressure of the first pressure gas is greater than that of the second pressure gas;

a second pressure supply passage in fluid communication with the second variable-capacity valve for supplying the first pressure gas or the second pressure gas;

wherein:

when the first pressure supply passage supplies the second pressure gas and the second pressure supply passage supplies the first pressure gas, the first variable-capacity valve is at the communication position of the first variable-capacity valve and the second variable-capacity valve is at the isolation position of the second variable-capacity valve, such that the first cylinder operates and the second cylinder is at least partially unloaded, when the first pressure supply passage supplies the first pressure gas and the second pressure supply passage supplies the second pressure gas, the first variable-capacity valve is at the isolation position of the first variable-capacity valve and the second variable-capacity valve is at the communication position of the second variable-capacity valve, such that the first cylinder is at least partially unloaded and the second cylinder operates, and when the first pressure supply passage supplies the second pressure gas and the second pressure supply passage supplies the second pressure gas, the first variable-capacity valve is at the communication position of the first variable-capacity valve and the second variable-capacity valve is at the communication position of the second variable-capacity valve, such that both the first cylinder and the second cylinder operate.

2. The variable-capacity compressor according to claim 1, wherein:

the first variable-capacity valve comprises a first pressure passage in fluid communication with the first pressure supply passage, wherein when the first variable-capacity valve is located in the isolation position of the first variable-capacity valve, the first pressure supply passage supplies the first pressure gas into the first compression chamber through the first pressure passage.

3. The variable-capacity compressor according to claim 2, further comprising a first accommodating chamber in communication with the first pressure supply passage, wherein the first variable-capacity valve is movably disposed in the first accommodating chamber, and wherein when the first pressure supply passage supplies the first pressure gas, the first variable-capacity valve moves from the communication position to the isolation position, and when the first pressure supply passage supplies the second pressure gas, the first variable-capacity valve is maintained in the communication position.

4. The variable-capacity compressor according to claim 3, further comprising:

at least one spring disposed between the first variable-capacity valve and an inner wall of the first accommodating chamber.

5. The variable-capacity compressor according to claim 3, wherein when the first variable-capacity valve is located in the communication position, an inner wall of the first pressure supply passage at a side of the first pressure supply passage distanced from a center of the first variable-capacity valve is spaced apart from a corresponding end face of the first variable-capacity valve.

6. The variable-capacity compressor according to claim 5, wherein a stop structure is disposed to the inner wall of the first accommodating chamber, and when the first variable-capacity valve is located in the communication position, the first variable-capacity valve abuts against the stop structure.

7. The variable-capacity compressor according to claim 3, wherein the compression mechanism is provided with a suction hole, a first end of the suction hole is configured as the first suction port, a second end of the suction hole is in communication with the first accommodating chamber, and a diameter of the second end of the suction hole is denoted as d1; when a sectional shape of the first variable-capacity valve is configured to be a square or rectangle, a width of the first variable-capacity valve is denoted as s, in which s and d1 satisfy: $s>d1$; when the first variable-capacity valve is in the shape of a cylinder, a diameter of the first variable-capacity valve is denoted as d2, in which, d1 and d2 satisfy: $d2>d1$.

8. The variable-capacity compressor according to claim 7, wherein when the first variable-capacity valve is cylindrical in shape, a central axis of the first variable-capacity valve intersects a central axis of the suction hole.

9. The variable-capacity compressor according to claim 7, wherein when the first variable-capacity valve is cylindrical in shape, d1 and d2 further satisfy: $d2 \geq d1+0.5$ mm.

10. The variable-capacity compressor according to claim 2, wherein the first variable-capacity valve comprises a second pressure passage, and when the first variable-capacity valve is located in the communication position, the second pressure passage communicates the first compression chamber with the first suction port.

11. The variable-capacity compressor according to claim 1, wherein the first variable-capacity valve is movable in a vertical direction or in a horizontal direction.

12. The variable-capacity compressor according to claim 1, wherein the first variable-capacity cylinder is provided with a sliding vane groove, a sliding vane is disposed in the sliding vane groove, and a part of the sliding vane groove located at a tail of the sliding vane is configured as a sliding vane chamber which is in communication with an interior of the housing.

13. The variable-capacity compressor according to claim 12, wherein a magnetic material member is disposed to the tail of the sliding vane groove.

14. The variable-capacity compressor according to claim 1, wherein a partition plate is disposed between the first cylinder and the second cylinder, and the first variable-capacity valve is disposed to at least one of the partition plate and the two bearings.

15. The variable-capacity compressor according to claim 1, wherein the compression mechanism is provided with a valve base, and the first variable-capacity valve is disposed on the valve base.

16. The variable-capacity compressor according to claim 1, wherein a displacement of the first variable-capacity cylinder is denoted as q, and an overall displacement of the variable-capacity compressor is denoted as Q, in which, q and Q satisfy: $q/Q \leq 50\%$.

17. A refrigeration device, comprising:

a variable-capacity compressor, comprising:

a housing;

a compression mechanism disposed in the housing and comprising two bearings and a cylinder assembly disposed between the two bearings;

wherein: the cylinder assembly comprises a first cylinder and a second cylinder, the first cylinder and the second cylinder are each configured as a variable-capacity cylinder, and the first cylinder comprises a first compression chamber and a first suction port and the second cylinder comprises a second compression chamber and a second suction port;

two first suction conduits connected to the first cylinder and the second cylinder respectively; and a first variable-capacity valve associated with the first cylinder and configured to be movable between a communication position where the first compression chamber is in fluid communication with the first suction port and an isolation position where the first compression chamber is isolated from the first suction port;

a second variable-capacity valve associated with the second cylinder and configured to be movable between a communication position where the second compression chamber is in fluid communication with the second suction port and an isolation position where the second compression chamber is isolated from the second suction port;

a first pressure supply passage in fluid communication with the first variable-capacity valve for supplying a first pressure gas or a second pressure gas, wherein a pressure of the first pressure gas is greater than that of the second pressure gas;

a second pressure supply passage in fluid communication with the second variable-capacity valve for supplying the first pressure gas or the second pressure gas;

wherein:

when the first pressure supply passage supplies the second pressure gas and the second pressure supply passage supplies the first pressure gas, the first variable-capacity valve is at the communication position of the first variable-capacity valve and the second variable-capacity valve is at the isolation position of the second variable-capacity valve, such that the first cylinder operates and the second cylinder is at least partially unloaded, when the first pressure supply passage supplies the first pressure gas and the second pressure supply passage supplies the second pressure gas, the first variable-capacity valve is at the isolation position of the first variable-capacity valve and the second variable-capacity valve is at the communication position of the second variable-capacity valve, such that the first cylinder is at least partially unloaded and the second cylinder operates, and when the first pressure supply passage supplies the second pressure gas and the second pressure supply passage supplies the second pressure gas, the first variable-capacity valve is at the communication position of the first variable-capacity valve and the second variable-capacity valve is at the communication position of the second variable-capacity valve, such that both the first cylinder and the second cylinder operate.

18. The refrigeration device according to claim 17, wherein the first variable-capacity valve comprises a first pressure passage in fluid communication with the first pressure supply passage, wherein when the first variable-capacity valve is located in the isolation position of the first variable-capacity valve, the first pressure supply passage supplies the first pressure gas into the first compression chamber through the first pressure passage.

19. The refrigeration device according to claim 18, wherein the variable-capacity compressor further comprises a first accommodating chamber in communication with the first pressure supply passage, wherein the first variable-capacity valve is movably disposed in the first accommodating chamber, and wherein when the first pressure supply passage supplies the first pressure gas, the first variable-capacity valve moves from the communication position to the isolation position, and when the first pressure supply passage supplies the second pressure gas, the first variable-capacity valve is maintained in the communication position.

20. The refrigeration device according to claim 19, wherein the variable-capacity compressor further comprises:

at least one spring disposed between the first variable-capacity valve and an inner wall of the first accommodating chamber.

* * * * *